US012638224B2

(12) United States Patent
Yoon

(10) Patent No.: US 12,638,224 B2
(45) Date of Patent: May 26, 2026

(54) REFRIGERATOR

(71) Applicant: LG ELECTRONICS INC., Seoul (KR)

(72) Inventor: Jungmin Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 203 days.

(21) Appl. No.: 18/271,372

(22) PCT Filed: Nov. 30, 2021

(86) PCT No.: PCT/KR2021/017913
§ 371 (c)(1),
(2) Date: Jul. 7, 2023

(87) PCT Pub. No.: WO2022/149724
PCT Pub. Date: Jul. 14, 2022

(65) Prior Publication Data

US 2024/0053080 A1 Feb. 15, 2024

(30) Foreign Application Priority Data

Jan. 7, 2021 (KR) ..... 10-2021-0002224

(51) Int. Cl.
*F25C 1/22* (2018.01)
*F25C 5/182* (2018.01)
(Continued)

(52) U.S. Cl.
CPC ..... *F25C 1/22* (2013.01); *F25C 5/182* (2013.01); *F25D 17/062* (2013.01); *F25D 17/08* (2013.01);
(Continued)

(58) Field of Classification Search
CPC ..... F25C 1/22; F25C 5/182; F25C 2400/10; F25D 17/062; F25D 17/08; F25D 2317/067
See application file for complete search history.

(56) References Cited

U.S. PATENT DOCUMENTS

2007/0084229 A1* 4/2007 Han ..... F25D 17/065 62/340
2011/0203305 A1* 8/2011 Schenk ..... F25D 17/065 62/344
(Continued)

FOREIGN PATENT DOCUMENTS

CN 107166838 B 12/2019
JP 2006-046749 A 2/2006
(Continued)

OTHER PUBLICATIONS

Extended European Search Report in European Appln. No. 21917886.0, mailed on Oct. 30, 2024, 7 pages.

*Primary Examiner* — Elizabeth J Martin
(74) *Attorney, Agent, or Firm* — Fish & Richardson P.C.

(57) ABSTRACT

The present invention relates to a refrigerator, comprising: a cabinet which forms a storage space; a door which opens and closes the open front of the storage space; a grill fan which forms the rear surface of the storage space and has a discharge port through which cold air is discharged; and an ice maker which is provided inside the storage space and provided in front of the discharge port to make ice, wherein the ice maker includes: an ice tray having a plurality of cells supplied with water for ice-making; a case in which the ice is accommodated; and a side duct provided on a side of the case and having an inlet facing the discharge port and an outlet facing the door so as to guide the cool air discharged from the discharge port toward the front of the ice maker.

19 Claims, 20 Drawing Sheets

(51) Int. Cl.
*F25D 17/06* (2006.01)
*F25D 17/08* (2006.01)

(52) U.S. Cl.
CPC .... *F25C 2400/10* (2013.01); *F25D 2317/067* (2013.01)

(56) References Cited

U.S. PATENT DOCUMENTS

| | | | | |
|---|---|---|---|---|
| 2017/0307281 | A1* | 10/2017 | Morgan | F25C 5/185 |
| 2020/0158413 | A1* | 5/2020 | Kim | F25C 1/10 |

FOREIGN PATENT DOCUMENTS

| | | | |
|---|---|---|---|
| JP | 2006250489 | A | 9/2006 |
| JP | 4310299 | B2 | 8/2009 |
| KR | 20060076863 | | 7/2006 |
| KR | 20070042020 | | 4/2007 |
| KR | 20120069686 | | 6/2012 |
| KR | 101455864 | | 11/2014 |
| WO | WO2008082216 | | 7/2008 |
| WO | WO 2019/111321 | A1 | 6/2019 |

* cited by examiner

REFRIGERATOR

CROSS-REFERENCE TO RELATED APPLICATIONS

This application is a National Stage application under 35 U.S.C. § 371 of International Application No. PCT/KR2021/017913, filed on Nov. 30, 2021, which claims the benefit of Korean Patent Application No. 10-2021-0002224, filed on Jan. 7, 2021. The disclosures of the prior applications are incorporated by reference in their entirety.

TECHNICAL FIELD

The present disclosure relates to a refrigerator.

BACKGROUND ART

Generally, a refrigerator is a home appliance for storing food at low temperature in an inner storage space covered by a refrigerator door and is configured to, by cooling the inside of the storage space using cold air generated through a heat exchange with a refrigerant circulating a refrigeration cycle, keep foods stored therein in optimal conditions.

Refrigerators are gradually becoming larger and multi-functional in accordance with changes in eating habits and the trend of high-end products, and refrigerators equipped with various structures and convenient devices considering user convenience are being released.

In particular, in recent years, there has been released a refrigerator including an automatic ice maker that can automatically make and store ice.

Typically, Korean Patent Publication No. 10-2012-0069686 discloses a structure in which an ice maker is provided in a freezer compartment and ice is made by automatically-supplied water and then stored after falling down.

A refrigerator having such a structure may have a structure in which the ice maker is disposed in front of a discharge port configured to discharge cold air, in order to facilitate supply of cold air into the ice maker to ensure ice-making performance of the ice maker.

However, in the case of such a structure, at least a portion of the discharge port may be covered by the ice maker, and as a result, there is a problem that cold air is not effectively supplied to a space in front of the ice maker.

Also, the circulation and supply of cold air throughout a storage space in which the ice maker is provided may not be facilitated, and in particular, in a case in which a space or structure for storing food is present in the space in front of the ice maker, there is a problem that food storage performance is degraded due to a poor supply of cold air.

DISCLOSURE

Technical Problem

Embodiments of the present disclosure are directed to providing a refrigerator capable of supplying cold air to a space in front of an ice maker.

Embodiments of the present disclosure are directed to providing a refrigerator allowing cold air to flow along a side of an ice maker and be supplied toward a space in front of the ice maker.

Embodiments of the present disclosure are directed to providing a refrigerator capable of, while ensuring ice-making performance of an ice maker, evenly cooling the inside of a freezer compartment in which the ice maker is provided.

Technical Solution

One embodiment of the present disclosure provides a refrigerator including: a cabinet configured to form a storage space; a door configured to open and close an open front surface of the storage space; a grille panel configured to form a rear surface of the storage space and have a discharge port formed therein to discharge cold air; and an ice maker provided inside the storage space, provided in front of the discharge port, and configured to make ice, wherein the ice maker includes an ice tray configured to have a plurality of cells formed therein to receive water to make ice, a case configured to accommodate the ice, and a side duct provided at a side surface of the case and formed to have an inlet facing the discharge port and an outlet facing the door to guide the cold air discharged from the discharge port toward a front of the ice maker.

The case may have: a case upper surface configured to form an upper surface; and a case peripheral surface configured to extend downward from the case upper surface and form a space in which the ice tray is accommodated, and the side duct may be formed to extend in a front-rear direction from the case peripheral surface.

The side duct may be separately molded from the case and coupled to the case peripheral surface.

The side duct may include: an upper restrainer formed at an upper portion of the side duct and coupled to the case upper surface; and a lower restrainer formed at a lower portion of the side duct and coupled to a lower end of the case peripheral surface.

The side duct may include: a linear portion configured to extend forward from the inlet of the side duct and extend parallel to the side surface of the case; and an inclined portion configured to extend from an end of the linear portion to the outlet of the side duct and extend in a direction approaching the side surface of the case.

The side duct may include a duct body configured to have the inlet and the outlet formed to be open in a rear surface and a front surface, respectively, and form a cold air flow path, and a plurality of duct grilles configured to divide an inside of the duct body may be formed inside the duct body.

An inclined surface configured to progressively protrude more outward toward a top may be formed at a lower portion of the duct body.

The grille may be formed to have a slope that becomes closer to the side surface of the case toward the outlet.

The side duct may be provided at one of both left and right side surfaces of the case that is far from a side surface of the storage space.

One of the both side surfaces of the case where the side duct is not provided may be spaced apart from the side surface of the storage space.

A guide duct configured to guide the cold air discharged from the discharge port may be provided between the ice maker and the discharge port, and the guide duct may include: an ice maker supply portion configured to extend toward the ice maker and supply the cold air discharged from the discharge port to the ice maker; and a side supply portion configured to extend to a separation space between the side surface of the case and the side surface of the storage space and allow a portion of the cold air discharged from the discharge port to flow along a side of the ice maker and move to a front of the ice maker.

The discharge port may laterally protrude past the ice maker and the side duct.

A guide duct configured to supply the cold air discharged from the discharge port to the ice maker may be provided between the discharge port and the ice maker, one portion of the discharge port may communicate with the guide duct, and the other portion of the discharge port may be open toward the inlet of the side duct and supply the cold air to the side duct.

An ice bin configured to store ice made in the ice maker may be provided under the ice maker, and the case may have an open lower surface so that ice transferred from the ice maker falls down and is accommodated in the ice bin.

A door basket may be provided at a rear surface of the door, and the outlet of the side duct may be open toward the door basket.

Advantageous Effects

The following advantageous effects can be expected from a refrigerator according to proposed embodiments.

In a refrigerator according to an embodiment of the present specification, since a side duct is provided at a side surface of an ice maker, cold air discharged from a discharge port disposed at a rear of the ice maker can be supplied to a front of the ice maker.

In particular, the side duct may extend to a front end of the ice maker and accordingly, allow the cold air discharged from the discharge port, disposed at a rear surface of a freezer compartment, to be guided toward the front of the ice maker without being distributed inside the freezer compartment.

Therefore, the cold air discharged from the discharge port can reach an area in front of the ice maker, and there is an advantage that even the area in front of the ice maker, where the supply of cold air is relatively poor, can be evenly cooled.

In particular, since an outlet of the side duct is disposed to face a freezer compartment door basket which is disposed in front of the ice maker, cold air can be smoothly supplied to the freezer compartment door basket, and thus the entire freezer compartment can be evenly cooled.

Also, the side duct may be mounted on a side surface of the ice maker, and accordingly, the side duct and the ice maker can be coupled by a simple operation after the side duct and a case of the ice maker are molded. In this way, productivity, ease of assembly, and service performance can be improved.

Further, due to the side duct being disposed at the side surface of the ice maker, there is an advantage that a flow rate of cold air supplied to the ice maker can be maintained. Also, since the height at which the ice maker is arranged can be maintained, there are advantages that the arrangement positions of other configurations inside the freezer compartment are not affected, and in particular, the height of an ice bin can be maintained, thus ensuring a certain ice storage capacity.

Also, since a lower end of the side duct is formed to be inclined, in a case in which goods to be stored are placed in an inner space of a storage member of the freezer compartment in which the ice maker is disposed, interference by the side duct can be minimized.

Also, the side duct may include a linear portion configured to extend parallel to a side surface of the case of the ice maker and an inclined portion configured to extend from a front end of the linear portion toward the side surface of the case.

Therefore, the cold air discharged from the side duct can be intensively supplied to a space in front of the ice maker due to a structure of an end of the inclined portion where the outlet is formed, and thus performance of cooling the space in front of the ice maker can be ensured.

Also, a plurality of grilles are provided at the outlet of the side duct, and thus an even supply of cold air is possible. In particular, since the grilles are formed to have directivity, there is an advantage that cold air discharged from the outlet of the side duct can be more effectively supplied to the space in front of the ice maker and the freezer compartment door basket.

Also, among both left and right side surfaces of the ice maker, the side surface opposite to a position where the side duct is disposed may be disposed to be spaced a predetermined distance apart from a sidewall surface of the storage space. Also, the guide duct is branched into an ice maker supply portion and a side supply portion, and thus one portion of cold air discharged from the discharge port and introduced into the guide duct may be supplied to the ice maker, and the other portion of the cold air may flow along a space between the ice maker and the sidewall surface and be supplied to the front of the ice maker.

Therefore, due to the guide duct and the side duct, cold air can be supplied along both side surfaces of the ice maker, and the space in front of the ice maker can be more effectively cooled.

Due to such a structure of the side duct and the guide duct, there are advantages that, even in a state in which the ice maker is disposed to cover at least a portion of the discharge port, cold air can be supplied to the entire area of the freezer compartment, and even cooling performance is ensured.

In particular, there is an advantage that, even in a case in which the ice maker makes spherical ice or the volume of the ice maker is large due to the ice maker being designed to have large ice-making capacity, sufficient cold air is supplied from the discharge port to ensure that a sufficient amount of ice is made and also simultaneously ensure that the freezer compartment is evenly cooled.

MODE FOR INVENTION

Hereinafter, specific embodiments of the present disclosure will be described in detail with reference to the accompanying drawings. However, the spirit of the present disclosure is not limited to embodiments proposed herein, and another less advanced invention or another embodiment included within the scope of the spirit of the present disclosure may be easily proposed by adding, changing, or omitting a component.

Directions will be defined prior to description. In embodiments of the present disclosure, a direction in which doors of a refrigerator shown in FIG. 1 are disposed may be defined as forward, a direction from the doors toward a cabinet may be defined as rearward, a direction toward a floor surface on which the refrigerator is installed may be defined as downward, and a direction moving away from the floor surface may be defined as upward.

Figure 1:
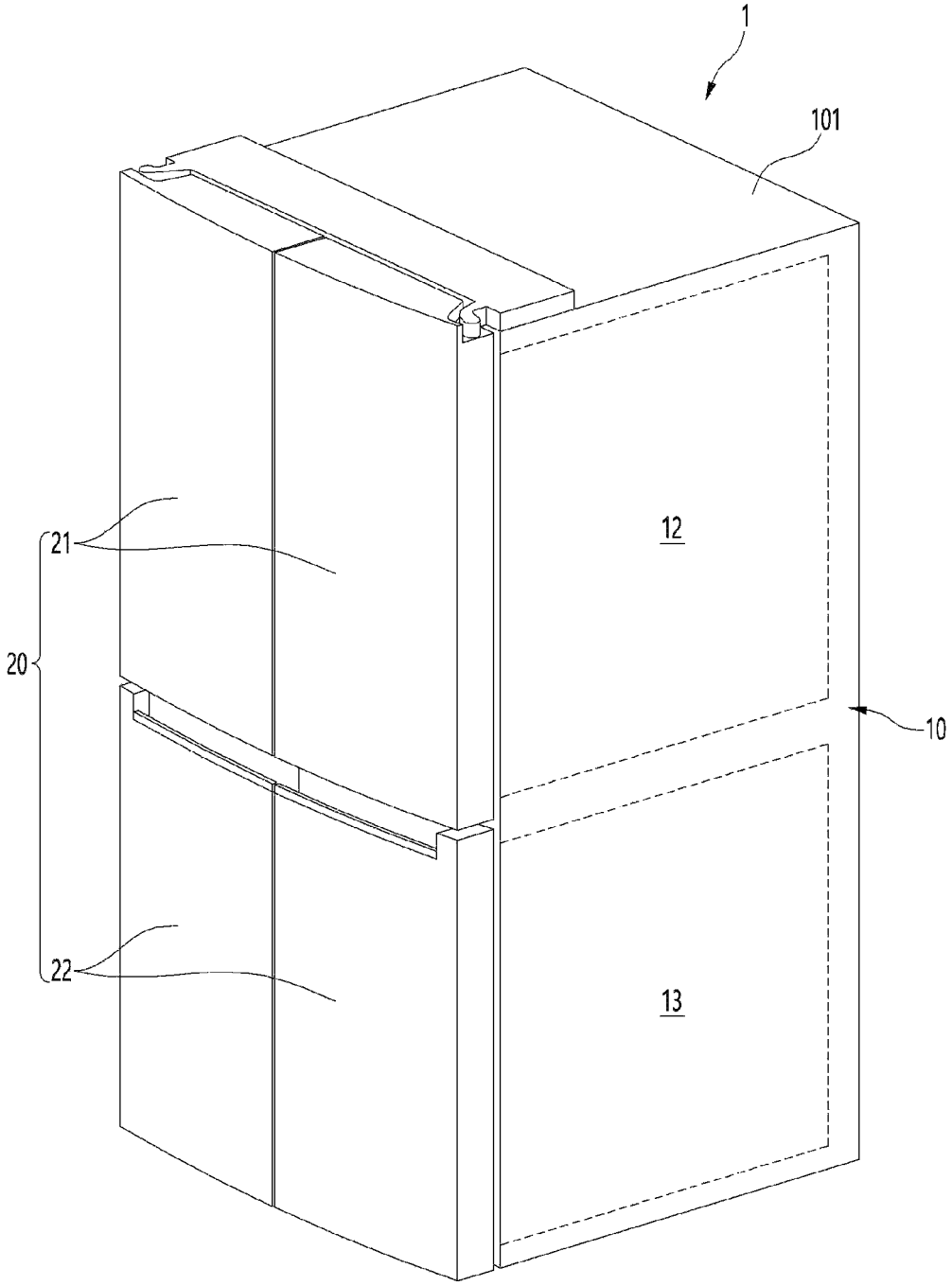
FIG. 1 is a perspective view of a refrigerator according to an embodiment of the present disclosure.
Figure 2:
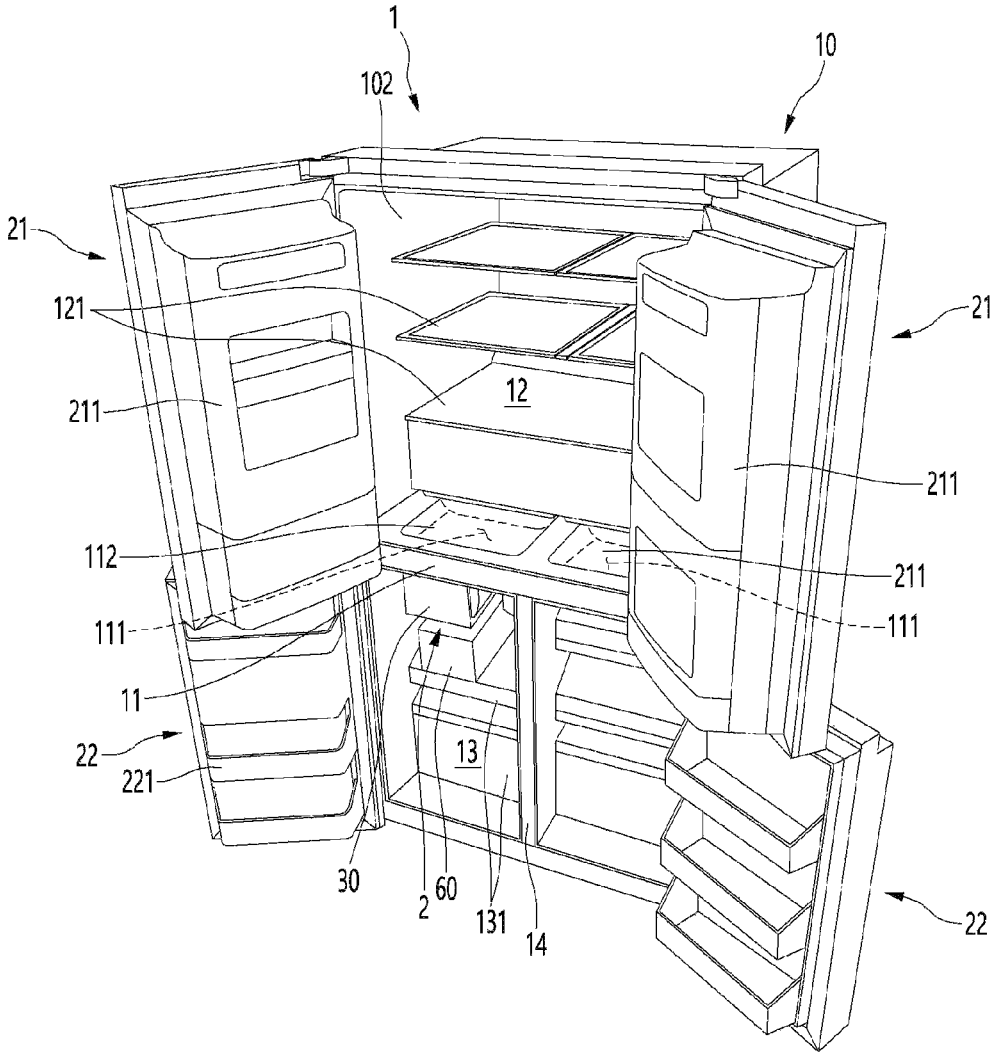
FIG. 2 is a perspective view in which doors of the refrigerator are open.
Figure 3:
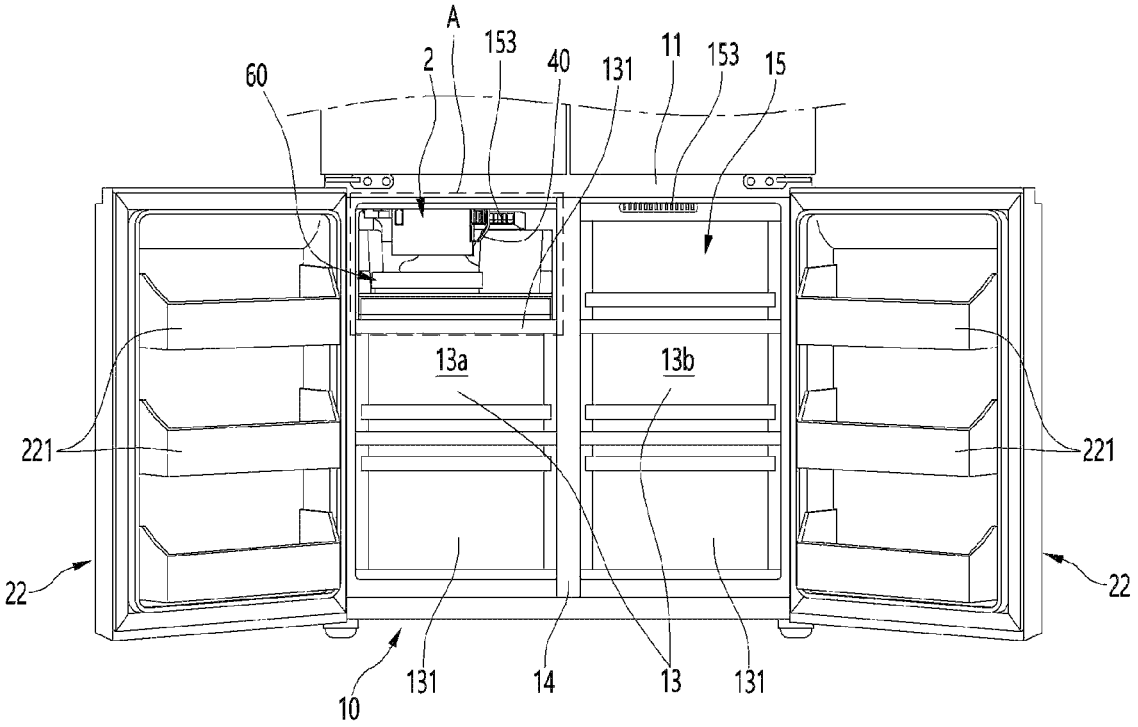
FIG. 3 is a front view in which lower doors of the refrigerator are open.

FIG. 1 is a perspective view of a refrigerator according to an embodiment of the present disclosure. Also, FIG. 2 is a perspective view in which doors of the refrigerator are open. Also, FIG. 3 is a front view in which lower doors of the refrigerator are open.

As illustrated in the drawings, a refrigerator 1 according to an embodiment of the present disclosure may include a cabinet 10 configured to form a storage space and doors 20 mounted on an open front surface of the cabinet 10 and configured to open and close the storage space.

The cabinet 10 may include an outer case 101 configured to form an exterior, an inner case 102 configured to form the storage space, and an insulator 103 (see FIG. 17) filled between the outer case 101 and the inner case 102.

The cabinet 10 may include a barrier 11, and the storage space may be divided into upper and lower spaces by the barrier 11. Accordingly, the storage space may be divided into an upper storage space 12 and a lower storage space 13. For example, the upper storage space 12 is easy for a user to access and thus may be used as a refrigerator compartment which is frequently used, and the lower storage space 13 may be used as a freezer compartment. Accordingly, the upper storage space 12 may be referred to as a refrigerator compartment 12, and the lower storage space 13 may be referred to as a freezer compartment 13.

The doors 20 may include an upper door 21 configured to cover the upper storage space 12 and a lower door 22 configured to cover the lower storage space 13. The upper door 21 may be referred to as a refrigerator compartment door 21, and the lower door 22 may be referred to as a freezer compartment door 22.

The upper door 21 may be configured as a pair of upper doors 21, and the pair of upper doors 21 may each rotate to open and close the upper storage space 12. The upper doors 21 may each be configured as a French type door and open and close a portion of the upper storage space 12.

Also, although not illustrated, the upper doors 21 may each have a double-door form that consists of a main door having an opening formed therein and a sub door rotatably disposed in front of the main door to open and close the opening.

A basket, or a door storage member 211 having a separate storage space, may be further provided at a rear surface of each upper door 21, that is, a surface of each upper door 21 that faces the refrigerator compartment 12.

The lower door 22 may be provided as a pair of lower doors 22 at both left and right sides like the upper doors 21 and may open and close the lower storage space 13. Also, the lower doors 22 may be referred to as freezer compartment doors 22.

Also, a door basket 221 may be provided at a rear surface of each lower door 22, that is, a surface of each lower door 22 that faces the freezer compartment 13. The door basket 221 may be provided as a plurality of door baskets 221 vertically disposed while spaced apart from each other. Also, the door basket 221 may be detachably provided. Also, the door basket 221 may, instead of having a detachable form, include a structure having a form in which goods can be stored due to the shape of a back surface of the lower door 22.

A refrigerator compartment storage member 121, such as a drawer or a shelf, may be provided inside the refrigerator compartment 12. A plurality of refrigerator compartment storage members 121 may be vertically disposed or may be disposed parallel to each other at both left and right sides.

A recessed storage portion 111 may be further formed in a bottom surface of the refrigerator compartment 12. The storage portion 111 may be formed to be recessed downward in an upper surface of the barrier 11, and a storage space may be formed in a space recessed due to the storage portion 111, that is, a recessed area of the barrier 11. The storage portion 111 may be formed to be recessed to a depth at which a lower surface of the barrier 11 corresponding to the position of the storage portion 111 does not protrude downward.

Also, the storage portion 111 may be positioned at a front end of the bottom surface of the refrigerator compartment 12 and may be disposed further toward the front than the refrigerator compartment storage member 121, which is disposed at a rear, and thus be formed at a position that is not covered by the refrigerator compartment storage member 121 and is easy to access by a user. Also, a storage portion cover 112 configured to open and close an open upper surface of the storage portion 111 may be further provided at the storage portion 111.

A freezer compartment storage member 131 may be provided inside the freezer compartment 13. For example, the freezer compartment storage member 131 may be configured as a drawer that can be inserted and withdrawn, and a plurality of freezer compartment storage members 131 may be vertically disposed. The insertion/withdrawal structure of the freezer compartment storage member 131 may facilitate storage of foods inside the freezer compartment 13 positioned at a lower portion.

A freezer compartment barrier 14 configured to divide the freezer compartment 13 into left and right spaces may be provided in the freezer compartment 13. The freezer compartment barrier 14 may be disposed at the center of the freezer compartment 13 in the horizontal direction and may extend from the lower surface of the barrier 11 to a bottom of the freezer compartment 13. Also, the spaces obtained due to the freezer compartment 13 being divided by the freezer compartment barrier 14 may be opened and closed by the pair of freezer compartment doors 22.

An ice maker 2 may be provided inside the freezer compartment 13. The ice maker 2 may be disposed at an upper surface of the freezer compartment 13 and may be exposed to the front when the freezer compartment door 22 is open. The ice maker 2 may only be disposed in one-side space 13*a* of spaces 13*a* and 13*b* at both left and right sides that are obtained due to the freezer compartment 13 being divided.

The ice maker 2 may be configured so that water supply, ice making, and ice transferring are automatically performed and may also be referred to as an automatic ice maker. Also, an ice bin 60 may be provided under the ice maker 2. The ice bin 60 may be formed in the shape of a basket in which ice made in the ice maker 2 is stored after falling down. Also, the ice bin 60 may be seated on the freezer compartment storage member 131 and may be inserted and withdrawn together when the freezer compartment storage member 131 is inserted and withdrawn.

The ice maker 2 may make ice using cold air supplied into the freezer compartment 13. Accordingly, the ice maker 2 may have an arrangement structure that facilitates supply of cold air. Also, the inside of the freezer compartment 13 may have a structure that simultaneously facilitates supply of cold air into the ice maker 2 and supply of cold air into the freezer compartment 13.

For example, the ice maker 2 may be disposed so that a short side thereof is in a front-rear direction. Also, as illustrated in FIG. 3, when the freezer compartment 13 is viewed from the front in a state in which the freezer compartment doors 22 are open, a portion of a discharge port 153 is exposed to a side in a state in which the ice maker 2 is mounted. Accordingly, cold air discharged from the discharge port 153 may be simultaneously supplied into the ice maker 2 and the freezer compartment 13.

Here, some of the cold air discharged from the discharge port 153 may be guided by a guide duct 18 and a side duct 40, which will be described below, and flow along both side surfaces of the ice maker 2 and be supplied to the front of the ice maker 2, in addition to being supplied into the ice maker 2.

Hereinafter, an inner structure of the freezer compartment 13 will be described in more detail with reference to the drawings.

Figure 4:
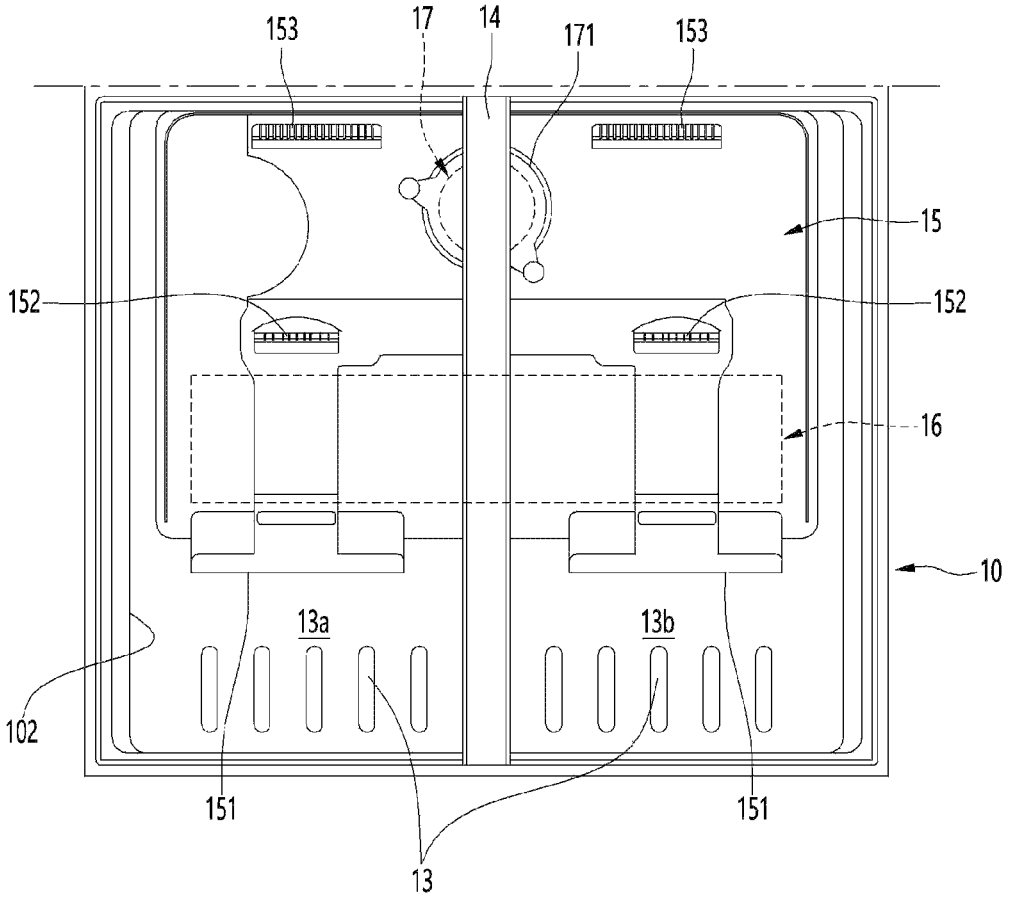
FIG. 4 is a front view showing an inside of a lower storage space of the refrigerator.
Figure 5:
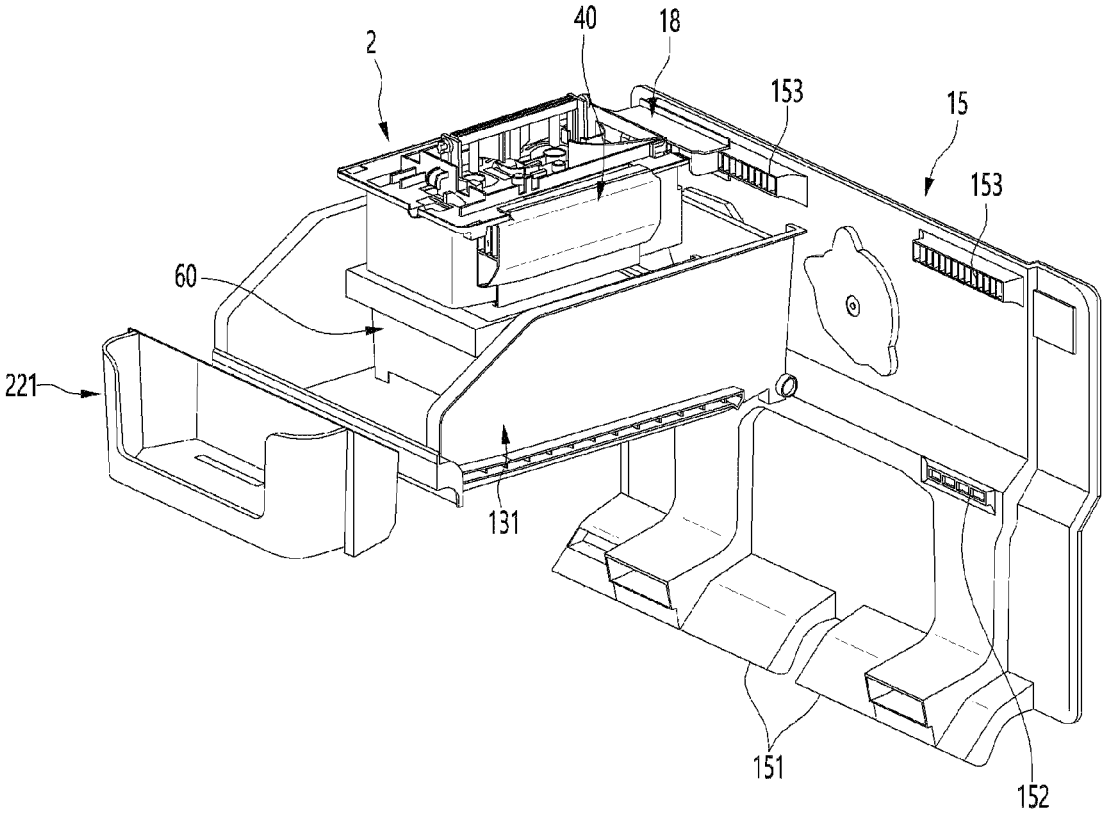
FIG. 5 is a perspective view showing the arrangement of a grille panel, an ice maker, and a storage member disposed in the lower storage space.
Figure 6:
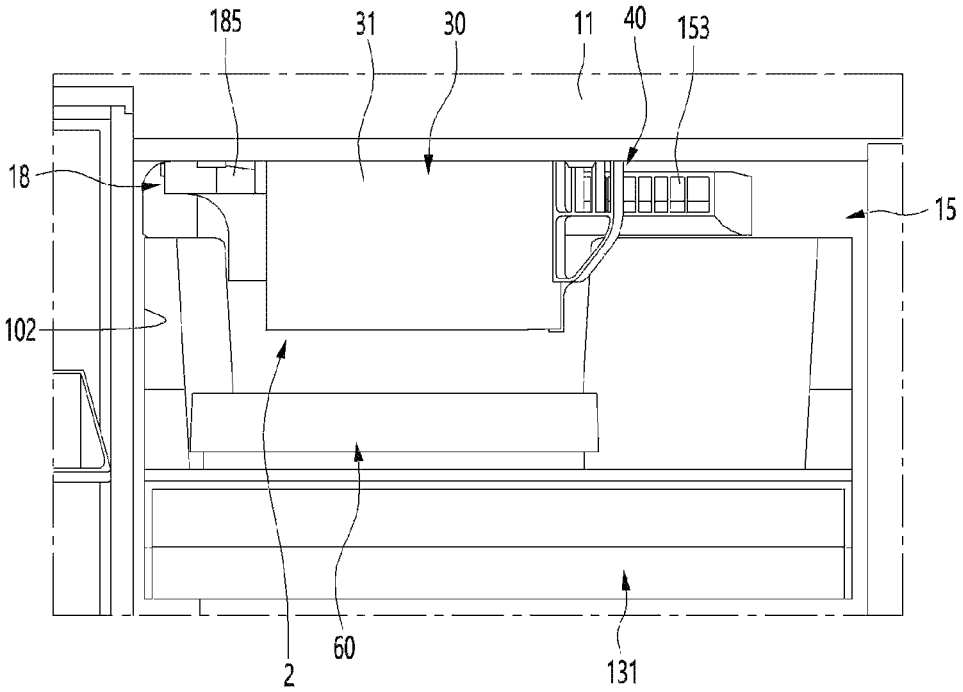
FIG. 6 is an enlarged view of portion A of FIG. 3.
Figure 7:
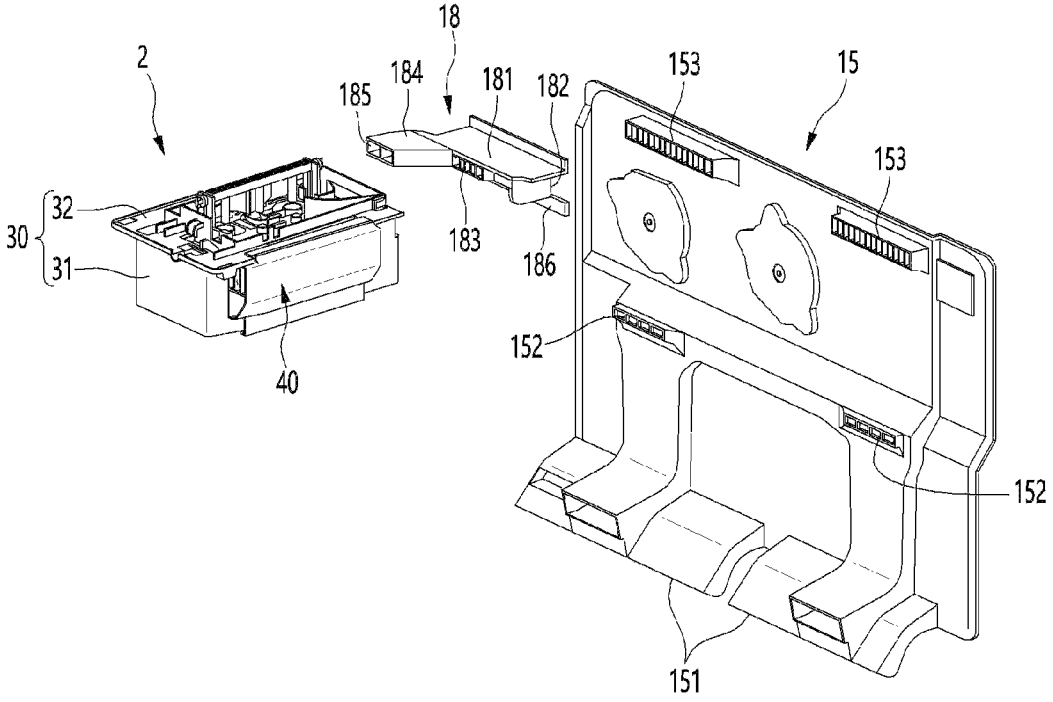
FIG. 7 is an exploded perspective view showing a coupling structure of the grille panel, the ice maker, and a guide duct.
Figure 8:
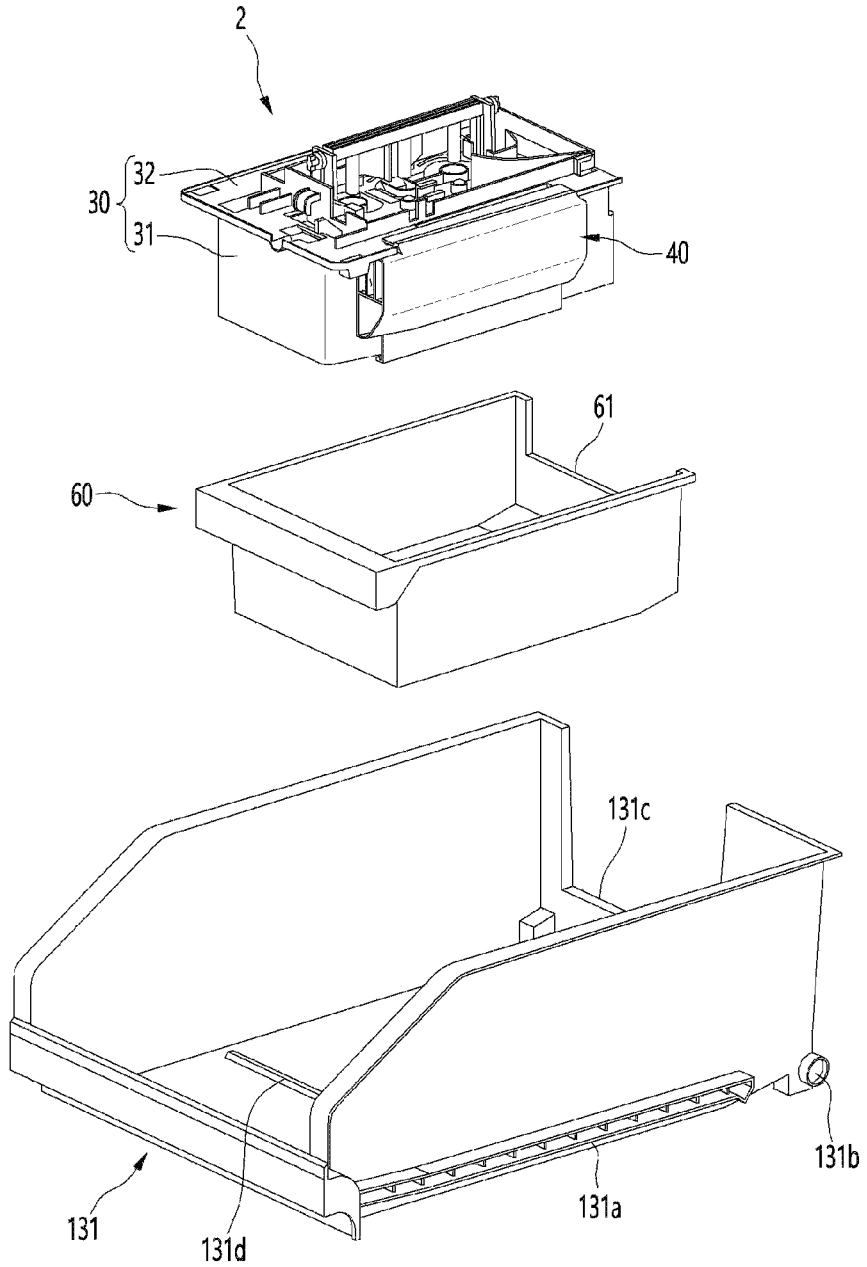
FIG. 8 is an exploded perspective view showing a coupling structure of the ice maker, an ice bin, and the storage member.

FIG. 4 is a front view showing an inside of a lower storage space of the refrigerator. Also, FIG. 5 is a perspective view showing the arrangement of a grille panel, an ice maker, and a storage member disposed in the lower storage space. Also, FIG. 6 is an enlarged view of portion A of FIG. 3. Also, FIG. 7 is an exploded perspective view showing a coupling structure of the grille panel, the ice maker, and a guide duct. Also, FIG. 8 is an exploded perspective view showing a coupling structure of the ice maker, an ice bin, and the storage member.

As illustrated in the drawings, the freezer compartment 13 may be formed by the inner case 102. Also, at least a portion of a rear surface of the freezer compartment 13 may be formed by a grille panel 15.

The grille panel 15 may be formed in a plate shape and may cover an evaporator 16 disposed at a rear. That is, the grille panel 15 may divide a space of the freezer compartment 13, which is formed by the inner case 102, in the front-rear direction and may form a space in which the evaporator 16 may be accommodated.

The space of the freezer compartment 13 that is in front of the grille panel 15 may be divided into a left-side space 13*a* and a right-side space 13*b* by the freezer compartment barrier 14. Here, the left-side space 13*a* and the right-side space 13*b* may also be connected in a state in which cold air can flow through the space behind the grille panel 15. Of course, the left-side space 13*a* and the right-side space 13*b* may have structures that allow independent temperature control as necessary.

An air blower fan 17 may be provided above the evaporator 16. That is, due to driving of the air blower fan 17, cold air generated in the evaporator 16 may be supplied to the freezer compartment 13. The air blower fan 17 may be mounted on a fan mounting portion 171 and may be accommodated in a fan case 173 disposed at a rear surface of the grille panel 15, and the fan case 173 may be formed to guide suction and discharge of cold air into and from the evaporator 16 when the air blower fan 17 rotates. The air blower fan 17, the fan case 173, and the fan mounting portion 171 may be disposed at the center of the grille panel 15 and may be configured so that cold air is supplied to each of the left-side space 13*a* and the right-side space 13*b*.

A suction port 151 and the discharge port 153 may be formed in the grille panel 15, cold air may be discharged to the inside of the freezer compartment 13 through the discharge port 153, and air inside the freezer compartment 13 may be suctioned into the evaporator 16 through the suction port 151.

Specifically, the discharge port 153 may be positioned at an upper end of the grille panel 15 or at an upper portion thereof close to the upper end. The discharge port 153 may be provided as a plurality of discharge ports 153 and may be longitudinally formed in the horizontal direction. In particular, at least some of the discharge ports 153 may be positioned at positions facing the ice maker 2.

For example, the discharge port 153 may be positioned at a rear of the ice maker 2. Also, when viewed from the front, some of the discharge ports 153 may be covered by the ice maker 2, and the remaining discharge ports 153 may protrude to a side of the ice maker 2 and be exposed.

An intermediate discharge port 152 may be further formed at a substantially intermediate point along the height of the grille panel 15. The intermediate discharge port 152 may be formed above an upper end of the evaporator 16 and may be disposed further toward the rear than the ice maker 2. Accordingly, in the case in which the plurality of freezer compartment storage members 131 are vertically disposed, an area where each of the freezer compartment storage members 131 is disposed may be evenly cooled. The intermediate discharge port 152 may also be disposed in each of the left-side space 13*a* and the right-side space 13*b* or may be disposed at a substantially intermediate point in a left-right direction.

The suction port 151 may be formed at a lower end of the grille panel 15. The suction port 151 may be at the position of the evaporator 16 or positioned further toward the bottom than the evaporator 16 and may serve as a path along which air is suctioned from inside the freezer compartment 13. The suction port 151 may also be disposed in each of the left-side space 13*a* and the right-side space 13*b* or may be disposed at a substantially intermediate point in the left-right direction.

Also, although not illustrated in detail, a flow guide structure for a flow of cold air generated in the evaporator 16 and a distribution of cold air to the left-side space 13*a* and the right-side space 13*b* may be further formed at a rear of the grille panel 15.

Meanwhile, the guide duct 18 may be provided between the discharge port 153 and the ice maker 2. The guide duct 18 may be configured to supply some of the cold air discharged from the discharge port 153 toward the inside of the ice maker 2 and the sides of the ice maker 2.

In more detail, the guide duct 18 may have a structure that forms a cold air flow path branched from the discharge port 153 toward the ice maker 2.

The guide duct 18 may be mounted to be fixed to the discharge port 153. To this end, the discharge port 153 may be formed to protrude forward from the grille panel 15.

Also, the guide duct 18 may be formed to have an open rear surface, and a duct insertion portion 182 into which the discharge port 153 is inserted may be formed in the rear surface of the guide duct 18. Also, a duct edge 182 configured to come in contact with a front surface of the grille panel 15 may be formed along the periphery of the duct insertion portion 187.

Accordingly, when the guide duct 18 is mounted on the grille panel 15, the duct edge 187 may come in close contact with the front surface of the grille panel 15 and allow the guide duct 18 to be stably mounted.

A vertical width of an open rear end of the guide duct 18 may be formed to correspond to a vertical width of the discharge port 153 to allow the discharge port 153 to be inserted through the open rear surface of the guide duct 18. Also, one of both left and right sides of the duct edge 187 may be open, and a portion of the discharge port 153, whose horizontal length is longer than a horizontal length of the guide duct 18, may be exposed to the outside. Here, one of both left and right side surfaces of the guide duct 18 that is opposite to the duct insertion portion 182 supports one side surface of the discharge port 153.

In this way, the discharge port 153 may be inserted into the open rear surface of the guide duct 18, and here, the duct insertion portion 182 may accommodate a portion of the discharge port 153, and the duct edge 187 may come in close contact with the front surface of the grille panel 15 to allow the guide duct 18 to maintain a stably mounted state. Also, due to the guide duct 18, some of the cold air discharged from the discharge port 153 to the freezer compartment 13 may flow toward the inside of the freezer compartment 13, and the rest of the cold air may be guided through the guide duct 18.

The guide duct 18 may extend forward and may be branched into an ice maker supply portion 181, which is configured to communicate with the ice maker 2, and a side supply portion 184.

Specifically, the ice maker supply portion 181 may extend forward from the rear end of the guide duct 18. The ice maker supply portion 181 may extend from the discharge port 153 toward an ice maker inlet 315 disposed at a rear surface of the ice maker 2, in a state in which the guide duct 18 is mounted.

Also, a first guide outlet 183 may be formed at a front surface of the ice maker supply portion 181. The first guide outlet 183 may be disposed to face the ice maker inlet 315. Accordingly, some of the cold air discharged from the discharge port 153 may be introduced into the ice maker 2 via the ice maker supply portion 181. Also, at least one or more grilles may be formed in the guide duct 18 or the first guide outlet 183 to allow cold air flowing toward the ice maker inlet 315 to have directivity.

The side supply portion 184 may extend forward from a side end of the guide duct 18 and may be formed to protrude further toward the front than the ice maker supply portion 181. The side supply portion 184 may extend from the discharge port 153 toward one side of the ice maker 2, in the state in which the guide duct 18 is mounted.

Specifically, the side supply portion 184 may extend to a space between a side surface of the ice maker 2 and a side surface of the inner case 102. For example, a front end of the side supply portion 184 may be positioned in a space between a side surface of the ice maker 2 and a side surface of the freezer compartment 13. To this end, the side supply portion 184 may extend in an inclined or round shape.

Also, a second guide outlet 185 may be formed at a front end of the side supply portion 184. The second guide outlet 185 may be open toward a space between an outer side surface of a case 30 of the ice maker 2 and aside surface of the freezer compartment 13. Accordingly, some of the cold air discharged from the discharge port 153 may flow along a space between the ice maker 2 and the side surface of the freezer compartment 13 via the side supply portion 184.

Also, at least one or more grilles may be formed in the guide duct 18 or the second guide outlet 185 to allow cold air flowing toward the space between the ice maker 2 and the side surface of the freezer compartment 13 to have directivity.

Accordingly, when the freezer compartment 13 is viewed from the front in a state in which the lower door 22 is open and the ice maker 2 is exposed, the second guide outlet 185 may be exposed between the side surface of the freezer compartment 13 and the side surface of the ice maker 2, and the first guide outlet 183 may be covered by the ice maker 2 and not visible. Also, the side duct 40, which will be described below, and a portion of the discharge port 153 that protrudes to a side of the side duct 40 may also be exposed to the front.

Meanwhile, the ice maker 2 may be mounted on an upper surface of the freezer compartment 13, that is, the lower surface of the barrier 11. Also, the side duct 40, which will be described in detail below, may be mounted on one side surface of the ice maker 2. The side duct 40 may be provided at one of both left and right side surfaces of the ice maker 2 that is far from a sidewall surface of the freezer compartment 13.

Also, the ice bin 60 may be provided under the ice maker 2. The ice bin 60 is where ice made in the ice maker 2 is stored after being transferred from the ice maker 2 and may be formed in the shape of a basket having an open upper surface. Also, an empty opening 61 may be formed at a rear surface of the ice bin 60. The empty opening 61 may be opened to prevent interference with the ice maker 2 when the ice bin 60 is inserted and withdrawn.

The ice bin 60 may be seated on the freezer compartment storage member 131. Also, the freezer compartment storage member 131 may be mounted to be insertable and withdrawable into and from the freezer compartment 13. For example, an insertion/withdrawal guide 131*a*, which extends in the front-rear direction, and a roller 131*b* may be provided at both left and right side surfaces of the freezer compartment storage member 131. The insertion/withdrawal guide 131*a* may be supported by the sidewall surface of the freezer compartment 13 and guide insertion/withdrawal of the freezer compartment storage member 131. Also, during the insertion/withdrawal of the freezer compartment storage member 131, the roller 131*b* may rotate to further facilitate the withdrawal of the freezer compartment storage member 131.

The freezer compartment storage member 131 may be formed in the shape of a drawer having an open upper surface. In particular, an ice bin seating portion 131*d* on which the ice bin 60 may be seated and which is configured to prevent movement of the ice bin 60 during the insertion/withdrawal of the freezer compartment storage member 131 and allow the ice bin 60 to be accurately placed under the ice maker 2 may be formed inside the freezer compartment storage member 131. Also, a storage member opening 131*c* may be formed at a rear surface of the freezer compartment storage member 131 that corresponds to the empty opening 61, and the storage member opening 131*c* may prevent interference with the ice maker 2 during the insertion/withdrawal of the freezer compartment storage member 131.

Meanwhile, the ice bin 60 and the ice maker 2 may be partially accommodated in the freezer compartment storage member 131. Accordingly, the freezer compartment storage member 131 may be formed to be larger than the sizes of the ice bin 60 and the ice maker 2.

In particular, the freezer compartment storage member 131 may provide space so that other foods can be stored even in a state in which the ice bin 60 and the ice maker 2 are accommodated in the freezer compartment storage member 131. Accordingly, the freezer compartment storage member 131 may be formed to have a width larger than a width of the ice maker 2 in the left-right direction and a length longer than a length of the ice maker 2 in the front-rear direction. That is, by a front surface and a side surface of the freezer compartment storage member 131 formed to protrude to the front and side of the ice maker 2 in a state in which the freezer compartment storage member 131 is inserted, the freezer compartment storage member 131 may provide a food storage space.

Accordingly, among the plurality of freezer compartment storage members 131, the freezer compartment storage member 131 disposed at the top may provide space for storing food while providing space for placing the ice bin 60 where ice made in the ice maker 2 is stored.

Also, in a state in which the lower door 22 is closed, the door basket 221 may be disposed in front of the freezer compartment storage member 131, and cold air passing by the freezer compartment storage member 131 may be delivered to the door basket 221.

Hereinafter, the structure of the ice maker will be described in more detail with reference to the drawings.

Figure 9:
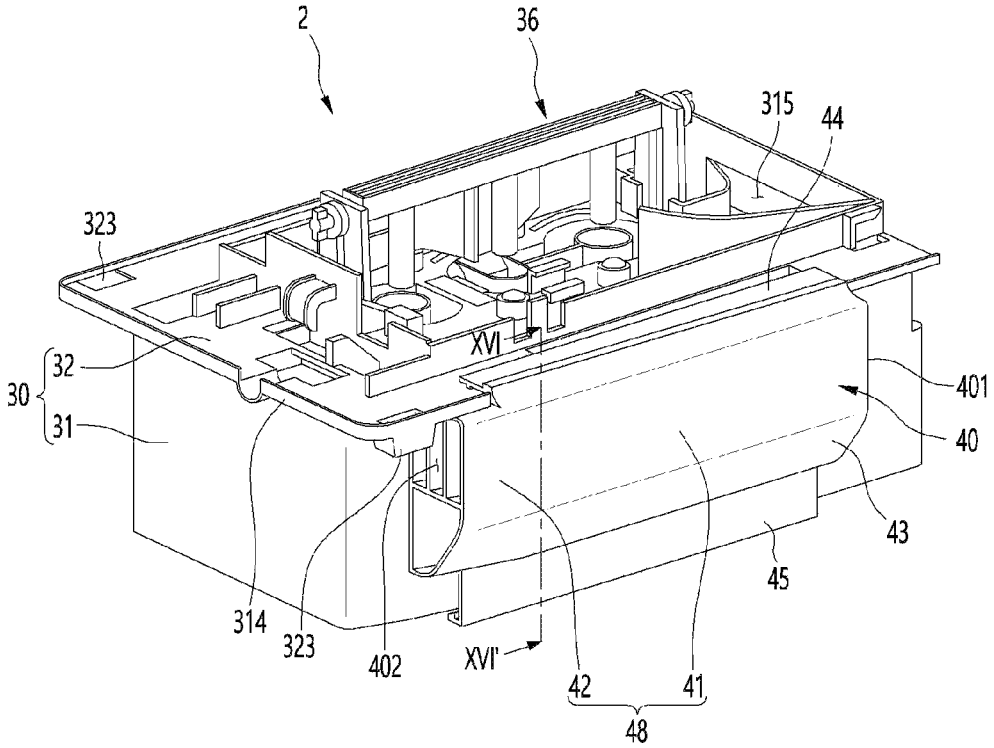
FIG. 9 is a perspective view of the ice maker.
Figure 10:
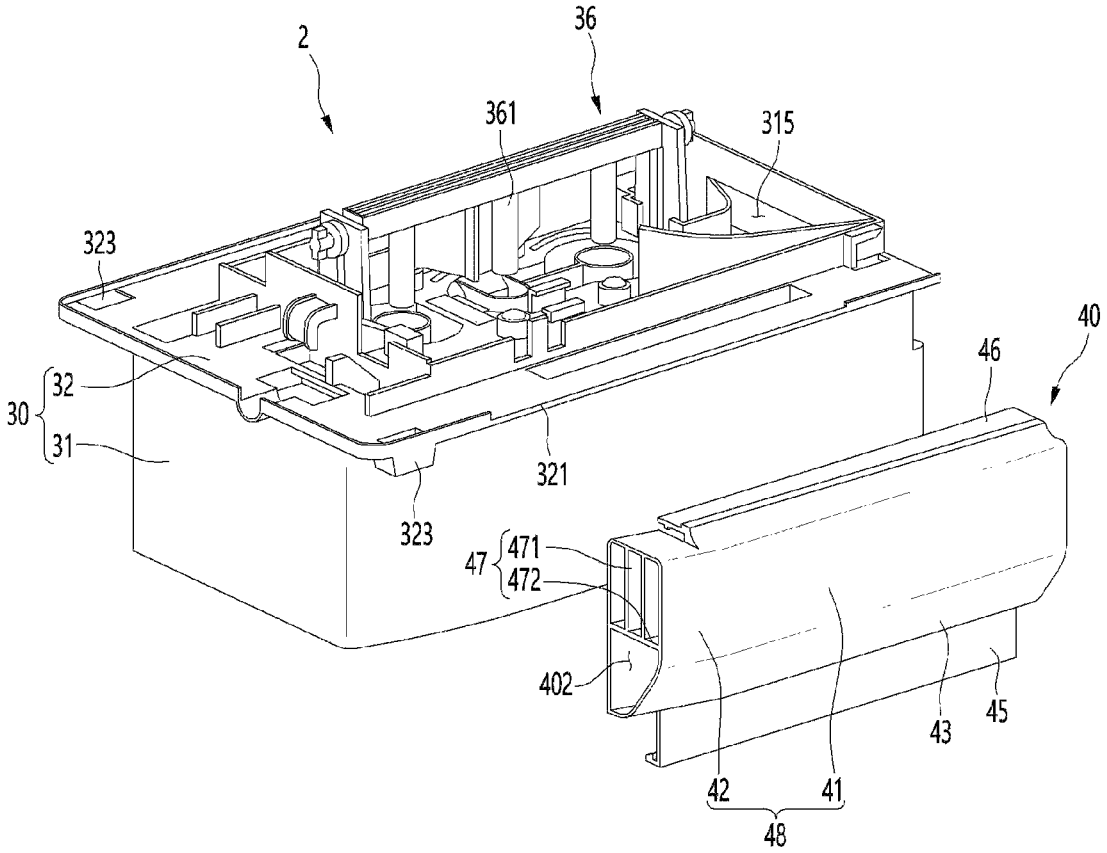
FIG. 10 is an exploded perspective view showing a coupling structure of the ice maker and a side duct.
Figure 11:
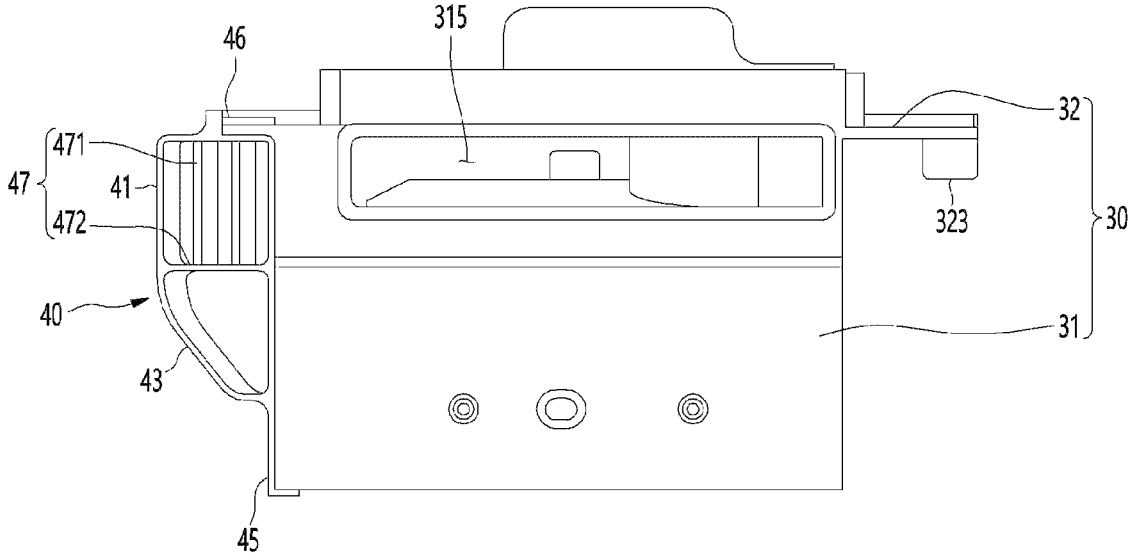
FIG. 11 is a rear view of the ice maker.
Figure 12:
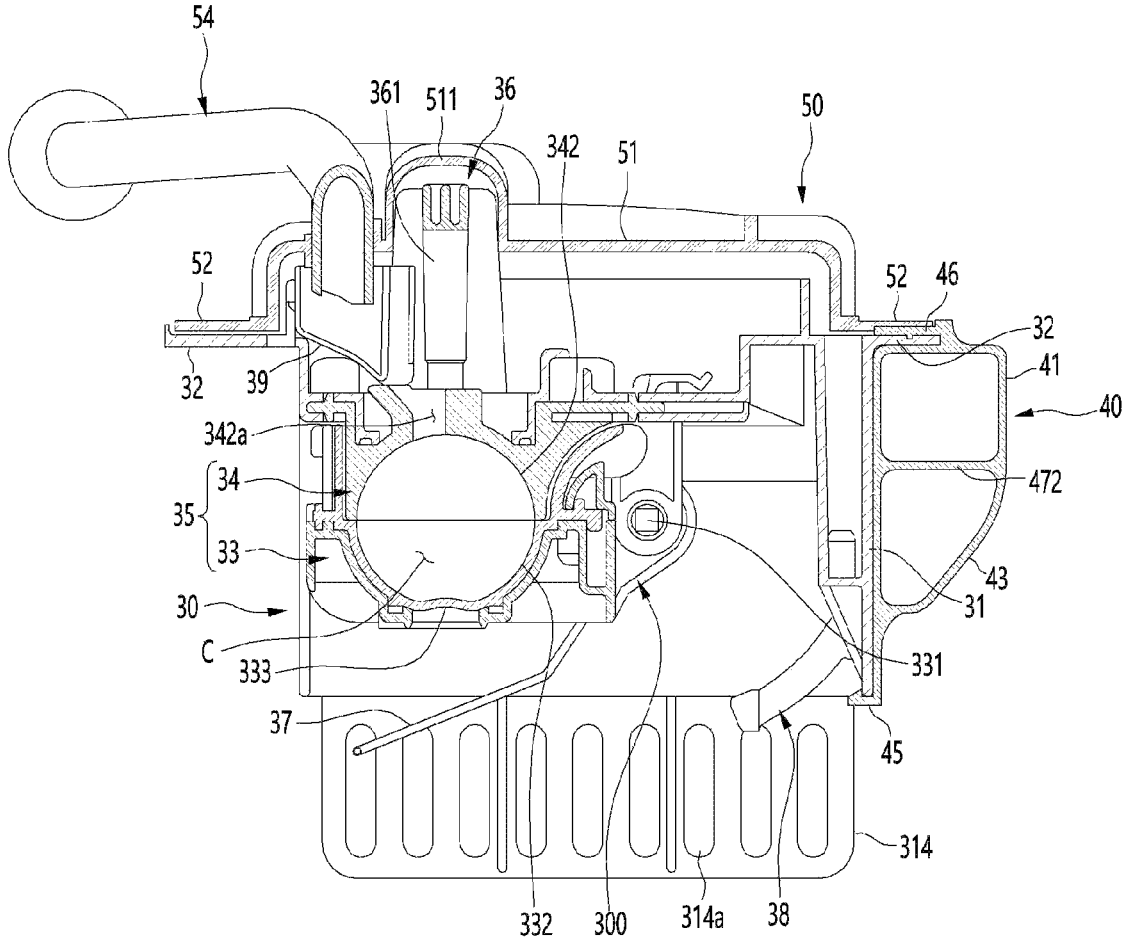
FIG. 12 is a longitudinal cross-sectional view of the ice maker.

FIG. 9 is a perspective view of the ice maker. Also, FIG. 10 is an exploded perspective view showing a coupling structure of the ice maker and a side duct. FIG. 11 is a rear view of the ice maker. Also, FIG. 12 is a longitudinal cross-sectional view of the ice maker.

The ice maker 2 receives water supplied thereto, makes ice, and then transfers the ice downward. The ice maker 2 may be an automatic ice maker in which processes including water supply, ice making, and ice transferring are automatically performed.

The ice maker 2 may include the case 30 configured to form an exterior, an ice tray 35 provided inside the case 30 and having a plurality of cells C formed therein to accommodate water and make ice, and a driving device 300 configured to rotate the ice tray 35. Also, the ice maker 2 may further include an ejector 36 configured to separate the made ice from the ice tray 35.

Each configuration of the ice maker 2 will be described in more detail. The case 30 may be formed of a plastic material and may, while forming the exterior of the ice maker 2, form a space for accommodating the ice tray 35.

The case 30 may include a case upper surface 32 configured to form an upper surface and a case peripheral surface 31 configured to extend downward along the periphery of the case upper surface 32. The ejector 36 may vertically move at the case upper surface 32 to push and transfer the ice inside the cells C. Also, the ice tray 35 and the driving device 300 may be disposed at an inner side of the case peripheral surface 31.

The case upper surface 32 may form a surface intersecting the case peripheral surface 31 and may extend further toward the outside than the case peripheral surface 31. Also, the periphery of the case upper surface 32 may be coupled to a mounting cover 50 mounted on the barrier 11. That is, the case upper surface 32 may be covered by the mounting cover 50.

Also, an upper tray 34 configured to form an upper portion of the ice tray 35 may be mounted to be fixed to the case upper surface 32. The upper tray 34 may form upper portions of the cells C. For example, the cells C may be formed in a spherical shape and make spherical ice, and a plurality of semispherical grooves that are open downward may be formed in a lower surface of the upper tray 34.

Also, tray holes 342*a* may be open at an upper end of the upper tray 34. The tray holes 342*a* may extend upward and be exposed through the case upper surface 32. The ejector 36 may enter and exit through the tray holes 342*a* and may push and discharge the ice made in the cells C.

At least any one of the tray holes 342*a* may be connected to a water supply member 39 configured to supply water and may serve as a path along which water for ice making is supplied to the plurality of cells C. The water supply member 39 may be formed in the shape of a cup with an open upper surface, and a water supply tube 54 inserted into the barrier 11 may be disposed above the water supply member 39. The water supply member 39 may allow water to be supplied to the cells C disposed in the middle among the plurality of cells C and may be disposed in the middle based on the horizontal length of the ice tray 35, that is, the length thereof in the left-right direction.

Also, the ice tray 35 may include a lower tray 33 disposed under the upper tray 34 and configured to form a lower portion of the ice tray 35. The lower tray 33 may be coupled to the upper tray 34 to form lower portions of the cells C. Accordingly, a plurality of semispherical grooves that are open upward may be formed in an upper surface of the lower tray 33.

When the upper tray 34 and the lower tray 33 are coupled to each other, the groove formed in the upper tray 34 and the groove formed in the lower tray 33 may be connected to each other and form the cell C having a spherical shape. The cell C may be formed as a plurality of cells C, and the plurality of cells C may be continuously disposed in a row. That is, the cells C may be continuously disposed in the front-rear direction when viewed from the front, the cells C may be disposed in a direction parallel to a direction in which cold air discharged from the discharge port 153 flows, or the cells C may be continuously disposed in a direction identical to a direction of extension of a cover flow path 420 which will be described below.

The lower tray 33 may be rotatably mounted on the driving device 300. A rotating shaft 331 of the lower tray 33 may be coupled to the driving device 300, and the lower tray 33 may, by rotating, allow the cell C to be open and ice made in the cell C to fall down.

Meanwhile, at least a portion of the upper tray 34 and at least a portion of the lower tray 33 may include an upper body 342 and a lower body 332, respectively, that are elastically deformable like rubber or silicone. For example, the upper body 342 and the lower body 332 of the upper tray 34 and the lower tray 33 that at least form the cell C may be formed of a rubber or silicone material. Accordingly, when the lower tray 33 rotates and thus comes in contact with the upper tray 34, the upper body 342 and the lower body 332 may come in close contact with each other and prevent leakage of water and may further facilitate ice transferring. The remaining portions of the upper tray 34 and the lower tray 33 may be formed of a plastic or metal material and provide structures that enable coupling and operation with other configurations.

Although not illustrated in detail, the driving device 300 may be formed by a combination of a motor configured to rotate and a plurality of gears configured to connect the motor and the rotating shaft 331. Also, the ejector 36 and an ice-full detection device 37, which will be described below, may be connected to the driving device 300, and operation of the driving device 300 may allow the ejector 36 and the ice-full detection device 37 to be operated.

The ejector 36 may be operated to transfer ice made in the cell C. The ejector 36 may be provided at an upper surface of the case 30 and may be configured to be connected to the driving device 300 and reciprocate vertically according to the movement of the lower tray 33. Accordingly, when ice making is complete and the lower tray 33 rotates, the cell C may be opened, and an ejecting rod 361 may pass through the tray hole 342*a* and push and discharge the ice.

Also, a lower ejector 38 may be further provided at the inner side of the case peripheral surface 31. The lower ejector 38 may protrude inward from a front surface of the case 30. Also, the lower ejector 38 may have a protruding end disposed within a radius of rotation of the lower tray 33 and extending to press one side of the lower tray 33, more specifically, a portion thereof corresponding to one side of the cell C, when the lower tray 33 rotates.

Specifically, when the lower tray 33 rotates and the cell C is opened, ice is discharged by the ejector 36, but in a case in which ice is placed in the lower tray 33, the lower ejector 38, which is fixed, may press one side of the lower tray 33 that corresponds to a lower portion of the cell C due to rotation of the lower tray 33 in order to discharge ice. Here, a portion of the lower tray 33 that comes in contact with the lower ejector 38 may be formed to be elastically deformable.

Of course, a heater may be further provided at the upper tray 34 and the lower tray 33. The heater may heat the upper tray 34 and the lower tray 33 to allow ice to be more easily separated from the cell C when ice making is complete.

Meanwhile, the ice-full detection device 37 may rotate under the lower tray 33, may have both ends respectively coupled to the ice-full detection device 37 and the case 30, and may rotate according to the operation of the driving device 300 to detect ice under the ice tray 35.

That is, when ice made in the ice bin 60 disposed under the ice tray 35 is accumulated at a predetermined height or more, the accumulation of ice may be detected by the ice-full detection device 37, and an additional ice making operation of the ice maker 2 may be stopped.

The case peripheral surface 31 may have an open rear surface, and another side surface, excluding one side surface, and front and rear surfaces of the case peripheral surface 31 extend downward from the case upper surface 32 and cover the ice tray 35 and prevent the ice tray 35 from being exposed. Also, a space which is open downward and in which the ice tray 35 and the driving device 300 can be disposed may be defined by the case upper surface 32 and the case peripheral surface 31. Due to forming the side periphery of the case 30, the case peripheral surface 31 may also be referred to as a case side surface.

Meanwhile, the ice maker inlet 315 through which cold air is introduced into the ice maker 2 may be formed at an upper end of a rear surface of the case 30. The ice maker inlet 315 may be open at an upper end of the case peripheral surface 31 and may longitudinally extend to both left and right sides.

The ice maker inlet 315 may be disposed to face the first guide outlet 183 of the guide duct 18. Also, the ice maker inlet 315 may have a structure adjacent or connected to the first guide outlet 402 and thus may allow cold air discharged through the first guide outlet 402 to be supplied to the inside of the ice maker 2 through the ice maker inlet 315.

The ice maker inlet 315 may be positioned at a height corresponding to an upper portion or upper surface of the upper tray 34, and accordingly, cold air introduced through the ice maker inlet 315 may cool the upper tray 34. Also, cold air introduced into the ice maker 2 may, while flowing downward from the inner side of the case peripheral surface 31, allow even an area of the lower tray 33 to be cooled.

Also, a covering plate 314 may be further formed at the case peripheral surface 31. The covering plate 314 may be mounted on the rear surface of the case peripheral surface 31 and may extend further toward the bottom than a lower end of the case peripheral surface 31. The case peripheral surface 31 may cover at least a portion of a space between a rear end of the ice maker 2 and a rear end of the ice bin 60 and may prevent ice from falling through a portion behind the ice bin 60 during the insertion/withdrawal of the ice bin 60.

Also, a ventilation hole 314*a* allowing cold air to flow through the covering plate 314 may be formed in the covering plate 314. Cold air passing through the ventilation hole 314*a* may cool a lower portion of the ice maker 2 and may be supplied into the ice bin 60 and cool ice stored therein.

Meanwhile, the mounting cover 50 may be mounted on an upper surface of the ice maker 2. A top cover 40 may be coupled to the case upper surface 32 of the ice maker 2. For example, a case coupling portion 323 may be formed at a corner of the case upper surface 32 and may be coupled to a mounting edge 52 forming the periphery of the mounting cover 50.

The mounting cover 50 may cover a space above the ice maker 2. Also, in a state in which the mounting cover 50 is mounted on the ice maker 2, a flow path along which cold air passes may be formed between the mounting cover 50 and the ice maker 2. Accordingly, cold air introduced through the ice maker inlet 315 may, while passing by the upper surface of the ice maker 2, cool water inside the ice tray 35 and allow ice to be made.

Also, the mounting cover 50 may cover a barrier opening 102*a* of the lower surface of the barrier 11 and may accommodate an upper portion of the ice maker 2. Also, the mounting cover 50 is coupled to the ice maker 2 to allow the ice maker 2 to be mounted on the lower surface of the barrier 11. Accordingly, the mounting cover 50 may also be referred to as a mounting bracket.

The mounting cover 50 may be formed of a plastic material and may include a mounting plate 51 formed in a plate shape and configured to form a recessed space 510 and the mounting edge 52 formed along the periphery of the mounting plate 51.

The mounting plate 51 may be formed in a shape that corresponds to the shape of the case upper surface 32, and in particular, an ejector accommodating portion 511 further recessed to accommodate the ejector 36 may be formed in the mounting plate 51.

The water supply tube 54 may be inserted into the mounting plate 51, and the water supply tube 54 inserted to pass through the mounting plate 51 may extend to the water supply member 39 and supply water to the water supply member 39.

Also, the mounting edge 52 may come in contact with the periphery of the barrier opening 102*a* which is open in the lower surface of the barrier 11. That is, the mounting cover 50 may be mounted so that the mounting plate 51 is inserted into the barrier opening 102*a* and the mounting edge 52 comes in close contact with the lower surface of the barrier 11. Accordingly, in a state in which the ice maker 2 is mounted on the barrier 11, a portion of the mounting cover 50 may be positioned in an area within the barrier 11. Also, the water supply tube 54 guided to the inside of the barrier 11 may be mounted to pass through the mounting cover 50.

The mounting edge 52 may be coupled to the case coupling portion 323 and may be firmly coupled thereto by screw fastening. That is, the ice maker 2 and the mounting cover 50 may be mounted to be fixed to the lower surface of the barrier 11 while being coupled to each other.

Meanwhile, the side duct 40 may be mounted on the case peripheral surface 31. The side duct 40 is for guiding cold air discharged from the discharge port 153 forward and may be mounted on one of both left and right side surfaces of the ice maker 2.

Specifically, the side duct 40 may be mounted on one of both left and right side surfaces of the ice maker 2 that is far from a side surface of the freezer compartment 13. That is, the side duct 40 may be mounted on one of both left and right side surfaces of the ice maker 2 that is farther from a wall surface of the freezer compartment 13. Also, the side duct 40 may be disposed to overlap an area of the discharge port 153 and may be disposed at a front of the discharge port 153.

The side duct 40 may be detachably mounted on the ice maker 2. The side duct 40 may be separately molded from the case 30 and configured to be attachable to and detachable from the case peripheral surface 31. The case 30 and the side duct 40 may be injection-molded using a plastic material, and the case 30 and the side duct 40, which have relatively complex shapes, may have structures coupled to each other after being separately molded. Accordingly, the case 30 and the side duct 40 may be easily molded.

The side duct 40 may extend along a side surface of the ice maker 2 and may extend from a second half portion of the ice maker 2 to a first half portion of the ice maker 2. Here, an inlet 401 which is open in a rear end of the side duct 40 may be formed to face the discharge port 153 and may extend to a position adjacent to the discharge port 153. Also, an outlet 402 which is open in a front end of the side duct 40 may be disposed at a position adjacent to a front surface of the ice maker 2. Accordingly, cold air discharged from the discharge port 153 may be discharged to the front of the ice maker 2 after moving along the side duct 40.

Meanwhile, an upper restrainer 46 configured to be coupled to a duct coupling portion 321 formed at the case upper surface 32 may be formed at an upper end of the side duct 40, and a lower restrainer 45 configured to be coupled to the lower end of the case peripheral surface 31 may be formed at a lower end of the side duct 40.

Hereinafter, the structure of the side duct 40 will be described in more detail with reference to the drawings.

Figure 13:
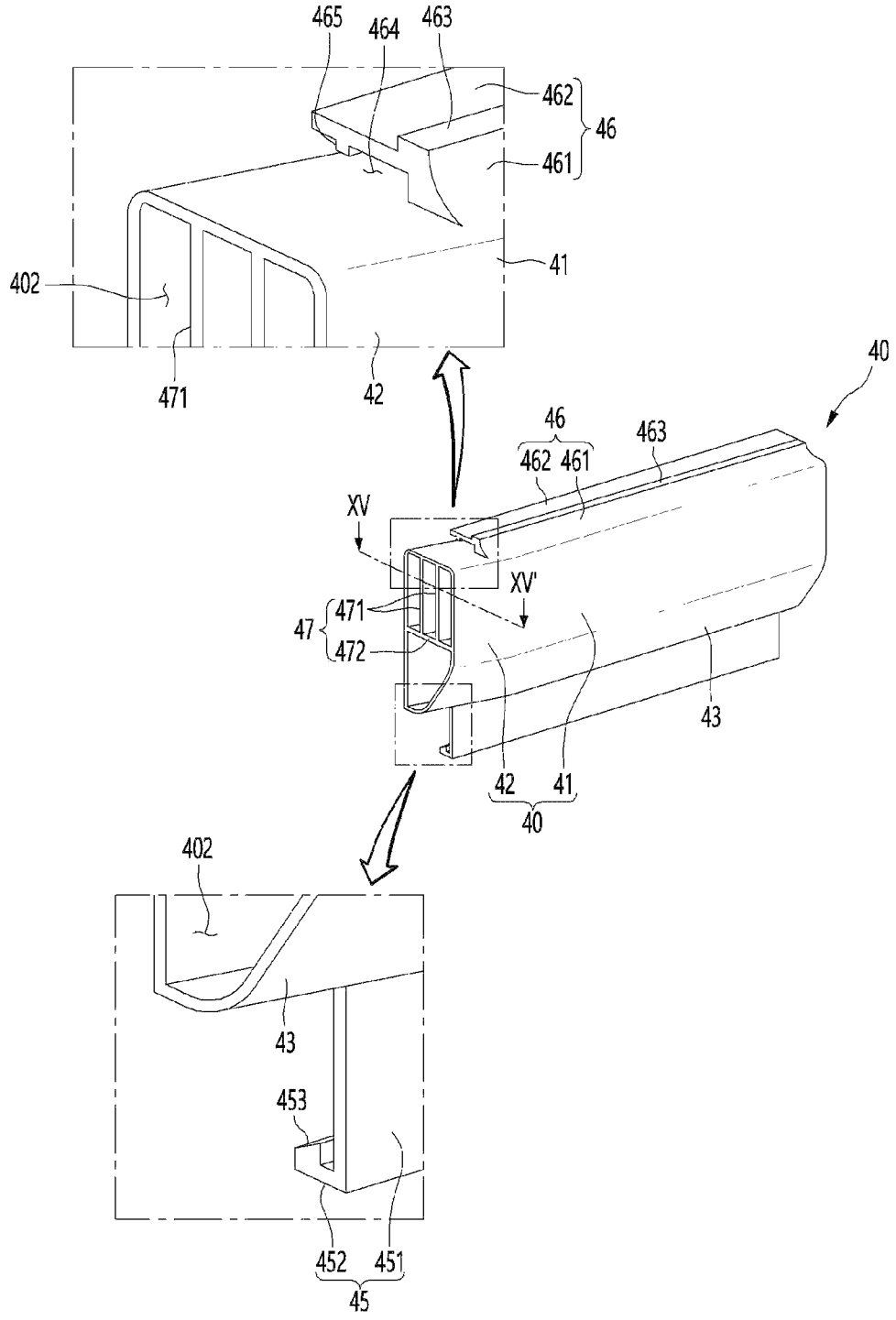
FIG. 13 is a perspective view of the side duct.
Figure 14:
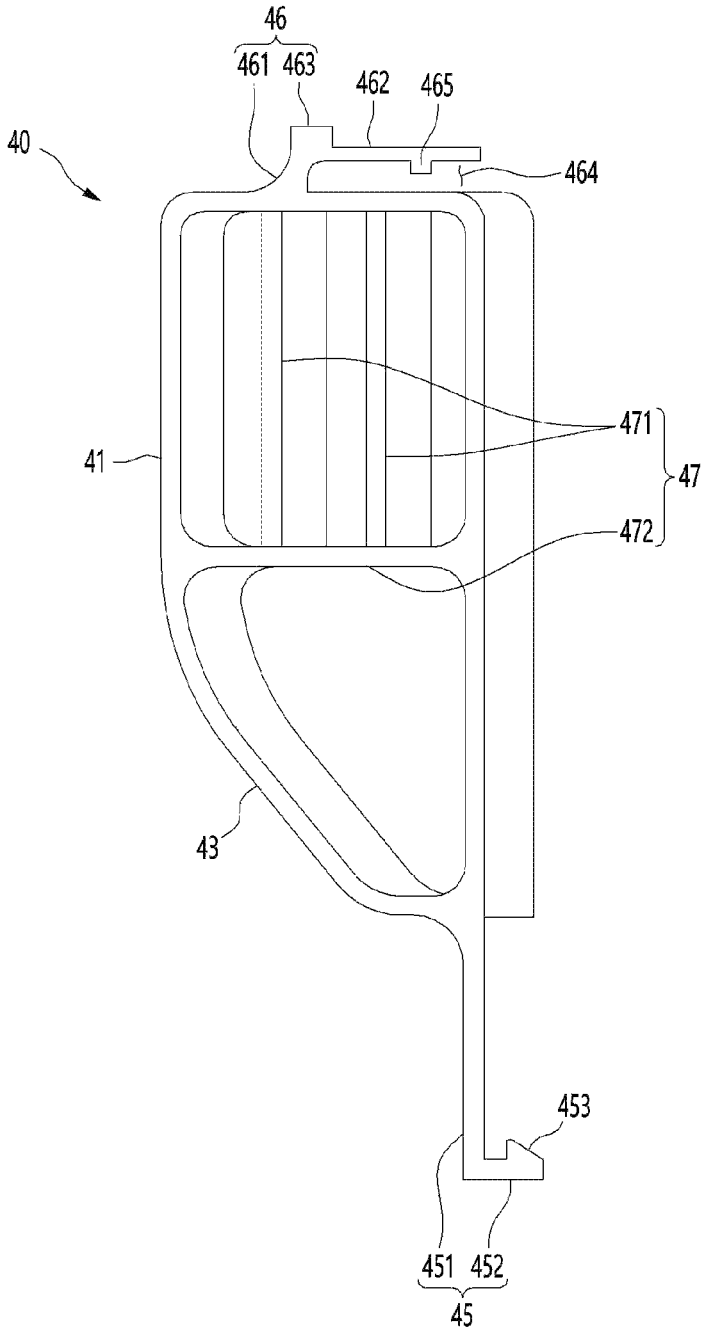
FIG. 14 is a rear view of the side duct.
Figure 15:
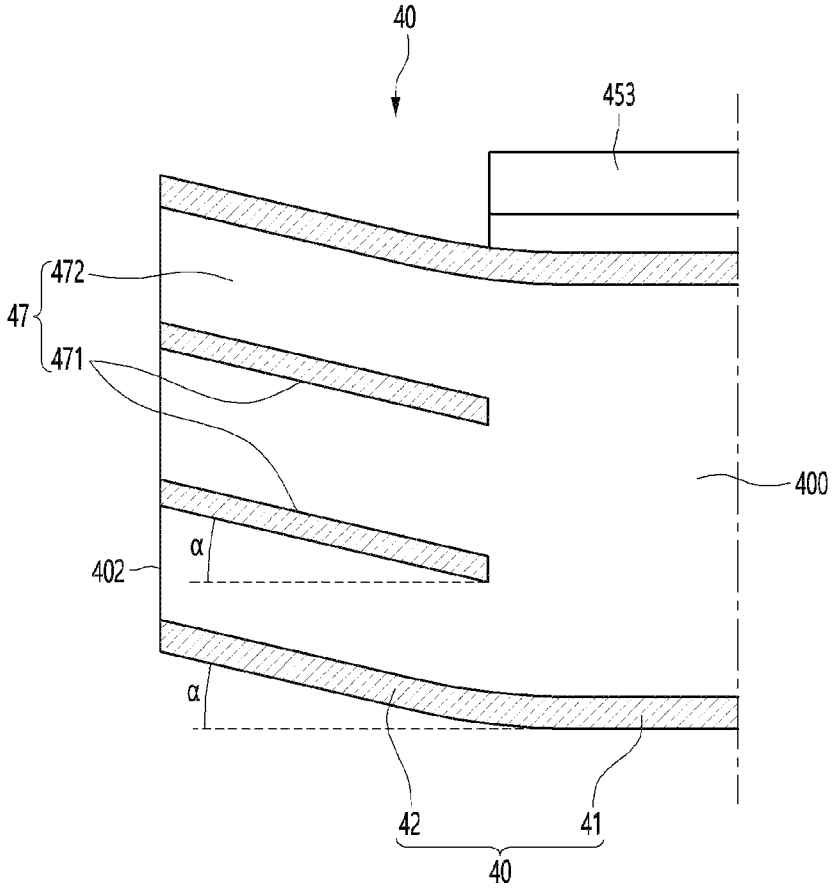
FIG. 15 is a cross-sectional view taken along line XV-XV' of FIG. 13.
Figure 16:
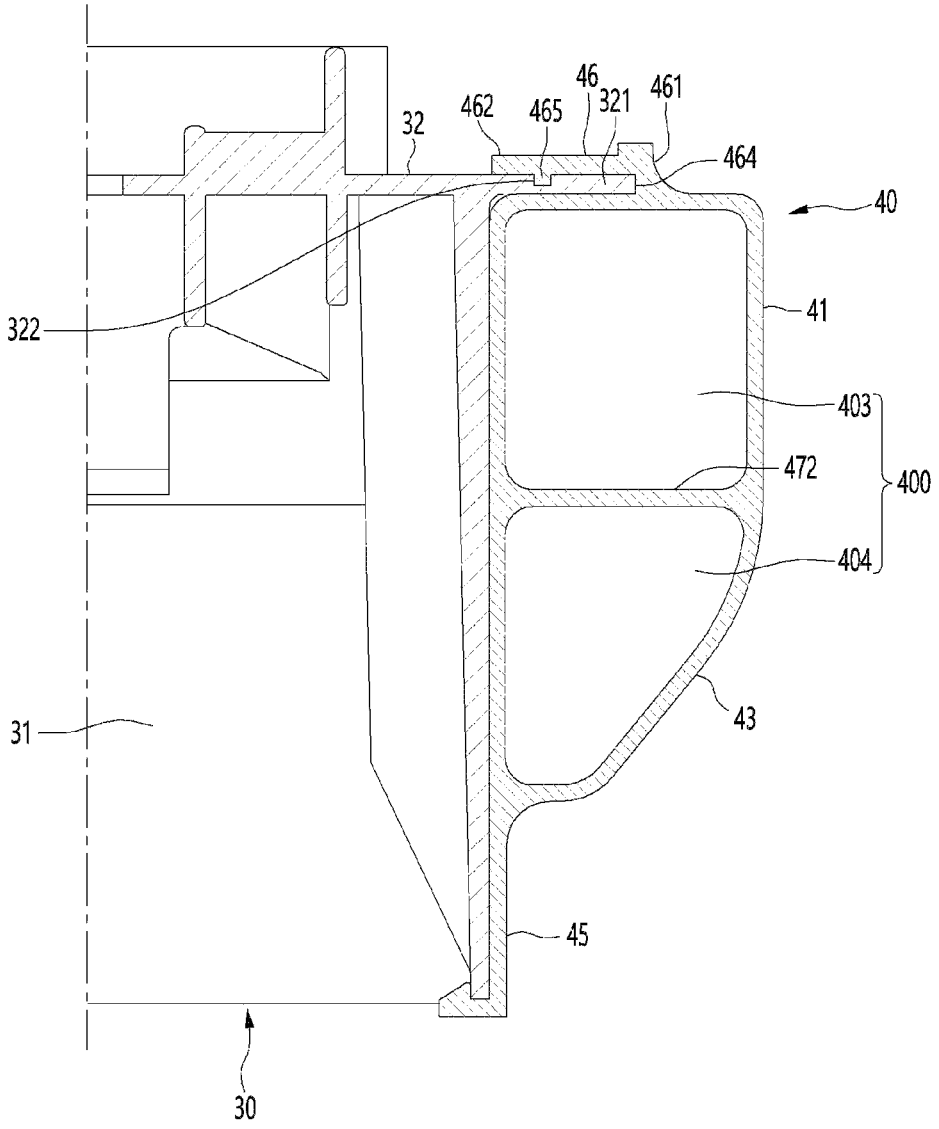
FIG. 16 is a cross-sectional view taken along line XVI-XVI' of FIG. 9.

FIG. 13 is a perspective view of the side duct. Also, FIG. 14 is a rear view of the side duct. Also, FIG. 15 is a cross-sectional view taken along line XV-XV' of FIG. 13. Also, FIG. 16 is a cross-sectional view taken along line XVI-XVI' of FIG. 9.

As illustrated in the drawings, the side duct 40 may be formed to longitudinally extend in the front-rear direction, may have a rear surface and a front surface formed to be open to form the inlet 401 and the outlet 402, respectively, and may have a hollow inner portion to form a cold air flow path 400.

The length of the side duct 40 in the front-rear direction may be formed to be less than or equal to the length of the case peripheral surface 31 in the front-rear direction. Also, the width of the side duct 40 in the up-down direction may be formed to be less than or equal to the width of the case peripheral surface 31 in the up-down direction.

The side duct 40 may include a duct body 48 configured to form the cold air flow path 400 as a whole and the upper restrainer 46 and the lower restrainer 45 respectively formed at an upper end and a lower end of the duct body 48.

Also, the duct body 48 may be defined as a portion forming the cold air flow path in the side duct 40. That is, the duct body 48 is a portion excluding the upper restrainer 46 and the lower restrainer 45, and the duct body 48 may include a linear portion 41 configured to extend forward from the inlet 401 and an inclined portion 42 formed to be inclined or rounded toward one side from the linear portion 41.

The linear portion 41 may extend in a direction parallel to an outer side surface of the case peripheral surface 31 and may extend parallel to the case peripheral surface 31. Accordingly, the linear portion 41 may form an area where cold air introduced through the inlet 401 is guided forward. The left-right width may be maintained to be the same in the area of the linear portion 41. The linear portion 41 may form a majority of the overall length of the side duct 40.

The inclined portion 42 is a portion extending from a front end of the linear portion 41 to the outlet and forms a front end portion of the side duct 40. The inclined portion 42 may be formed to be relatively shorter than the overall length of the linear portion 41.

Also, the inclined portion 42 may be formed to be progressively inclined or rounded in a direction approaching a side surface of the ice maker 2, that is, the case peripheral surface 31, as the inclined portion 42 extends further toward the front from the front end of the linear portion 41. The inclined portion 42 may be formed in a shape inclined at a predetermined angle $\alpha$ based on the linear portion 41. For example, the inclined portion 42 may be formed to be inclined at an angle of about 15° based on the linear portion 41.

Also, the outlet 402 may be formed at an end of the inclined portion 42. Accordingly, cold air that has passed through the linear portion 41 may flow in a direction somewhat biased toward one side while passing through the inclined portion 42 and may be discharged from the outlet 402 toward a space in front of the ice maker 2. That is, supply of cold air to the space in front of the ice maker 2, which is blocked by the ice maker 2 and thus difficult for cold air to reach by natural flow, becomes possible through the side duct 40.

Meanwhile, the inclined portion 42 may have a round shape with a predetermined curvature instead of having an inclined shape, and even in this case, cold air can be discharged to the front of the ice maker 2, and accordingly, the inclined portion 42 may also be referred to as a round portion.

Also, a duct grille 47 may be formed inside the side duct 40, that is, inside the duct body 48, to further facilitate a flow of cold air guided through the side duct 40.

The duct grille 47 may include a vertical grille 471 configured to extend in the up-down direction inside the duct body 48 and a horizontal grille 472 configured to extend in a direction intersecting the vertical grille 471.

The vertical grille 471 allows cold air discharged through the side duct 40 to have directivity, and the vertical grille 471 may be formed to be inclined at an angle identical to the angle α at which the inclined portion 42 is inclined. Also, the vertical grille 471 may be provided as a plurality of vertical grilles 471 disposed parallel to each other at predetermined intervals. Also, a front end of the vertical grille 471 may be disposed at a position corresponding to a front end of the inclined portion 42, that is, the outlet 402. Also, the vertical grille 471 may be formed only in an area of the inclined portion 42 in the duct body 48. That is, a width of the vertical grille 471 may be formed to be less than or equal to the length of the inclined portion 42 in the front-rear direction.

Accordingly, cold air discharged through the outlet 402 after passing through the inclined portion 42 may have directivity due to the vertical grille 471 and may be discharged to the space in front of the ice maker 2.

The horizontal grille 472 may connect a left side surface and a right side surface inside the duct body 48 and may divide an inner space of the duct body 48, that is, the cold air flow path 400, into an upper flow path 403 and a lower flow path 404. The horizontal grille 472 may extend from the inlet 401 to the outlet 402 and may be formed to divide the entire inner portion of the duct body 48 into upper and lower portions.

Accordingly, the horizontal grille 472 may allow cold air flowing along the inside of the side duct 40 to flow with more linearity and may prevent an uneven air flow inside the side duct 40. Also, the horizontal grille 472 may support an inner space of the side duct 40 and thus prevent deformation of the side duct 40 and allow the shape of the flow path to be maintained.

Meanwhile, the vertical grille 471 inside the duct body 48 may be formed to connect an upper surface of the horizontal grille 472 and an upper surface of the duct body 48. Also, the horizontal grille 472 may be disposed further toward the top than an upper end of an inclined surface 43 which will be described below. Accordingly, a cross-section of a flow path in which the vertical grille 471 is formed is formed in a quadrangular shape, and thus cold air may smoothly flow without being interfered by the inclined surface 43.

The inclined surface 43 may be formed at a lower surface of the duct body 48. The inclined surface 43 is a portion connecting the lower surface and a side surface of the duct body 48 and may be formed across a front end and a rear end of the duct body 48. The inclined surface 43 may have a structure that progressively protrudes more outward toward the top. Accordingly, the inclined surface 43 may be formed to avoid interference with the lower end of the side duct 40 when food is being stored in a space beside the ice maker 2, that is, the freezer compartment storage member 131.

Meanwhile, the upper restrainer 46 may be formed at the upper surface of the duct body 48. The upper restrainer 46 may be formed from the front end to rear end of the linear portion 41 and may be coupled to the duct coupling portion 321 formed at a side end of the case upper surface 32.

Specifically, the upper restrainer 46 may include an upper extending portion 461 configured to extend upward from the upper surface of the duct body 48 and a horizontal extending portion 462 configured to extend sideward from the upper extending portion 461. The upper extending portion 461 may extend to a height corresponding to the case upper surface 32. Also, an insertion portion 464 into which the side end of the case upper surface 32 is inserted may be formed between the upper surface of the duct body 48 and the horizontal extending portion 462 by the upper extending portion 461 and the horizontal extending portion 462.

Also, a restraining protrusion 465 configured to protrude downward may be further formed on an inner side of the insertion portion 464, that is, a lower surface of the horizontal extending portion 462, and a restraining hole 322 into which the restraining protrusion 465 is inserted may be formed in one side of the case upper surface 32 that corresponds to the restraining protrusion 465. Accordingly, when the side end of the case upper surface 32 is inserted into the upper restrainer 46, the restraining protrusion 465 is inserted into the restraining hole 322, and thus the case upper surface 32 and the upper restrainer 46 may maintain restrained to each other, and the upper end of the side duct 40 may be fixed to the case 30.

Meanwhile, a reinforcing portion 463 configured to protrude more than the horizontal extending portion 462 may be further formed at an upper end of the upper extending portion 461. The reinforcing portion 463 may serve to reinforce a connecting portion between the upper extending portion 461 and the horizontal extending portion 462 and reinforce the horizontal extending portion 462 to prevent damage to the horizontal extending portion 462 when the horizontal extending portion 462 is elastically deformed in the process in which the side end of the case upper surface 32 is inserted into the insertion portion 464.

Also, the lower restrainer 45 may be formed at the lower surface of the duct body 48, and the lower restrainer 45 may extend from the front end to rear end of the linear portion 41. The lower restrainer 45 may include a lower extending portion 451 configured to extend downward from the lower surface of the duct body 48. The lower extending portion 451 may extend to the lower end of the case peripheral surface 31.

The lower restrainer 45 may include a catching portion 452 configured to extend inward from a lower end of the lower extending portion 451. The catching portion 452 may extend to pass by the lower end of the case peripheral surface 31. Also, a hook 453 may be formed at an end of the catching portion 452. Accordingly, the lower restrainer 45 may be caught and restrained by the lower end of the case peripheral surface 31.

In this way, the side duct 40 may be mounted on a side surface of the ice maker 2. Specifically, for mounting of the side duct 40, first, the side end of the case upper surface 32, that is, the duct coupling portion 321, is inserted into the insertion portion 464 of the upper restrainer 46. Here, when the duct coupling portion 321 is completely inserted into the insertion portion 464, the restraining protrusion 465 is inserted into the restraining hole 322, and thus the upper restrainer 46 and the case upper surface 32 may be firmly fixed.

Next, when the lower restrainer 45 is placed at the lower end of the case peripheral surface 31 and then pushed in toward the case peripheral surface 31, the hook 453 is caught and restrained as the hook 453 passes by the lower end of the case peripheral surface 31, and thus the lower restrainer 45 and the case peripheral surface 31 may be firmly fixed.

Due to such a structure, the upper end and lower end of the side duct 40 may be coupled to the case of the ice maker 2 without screw fastening for separate coupling. Also, in a case in which the side duct 40 is needed to be separated, the lower restrainer 45 may be separated first, and then the upper restrainer 46 may be separated to easily separate the side duct 40 from the ice maker 2.

Hereinafter, the operation of the refrigerator 1 having the above-described structure will be described in more detail with reference to the drawings.

Figure 17:
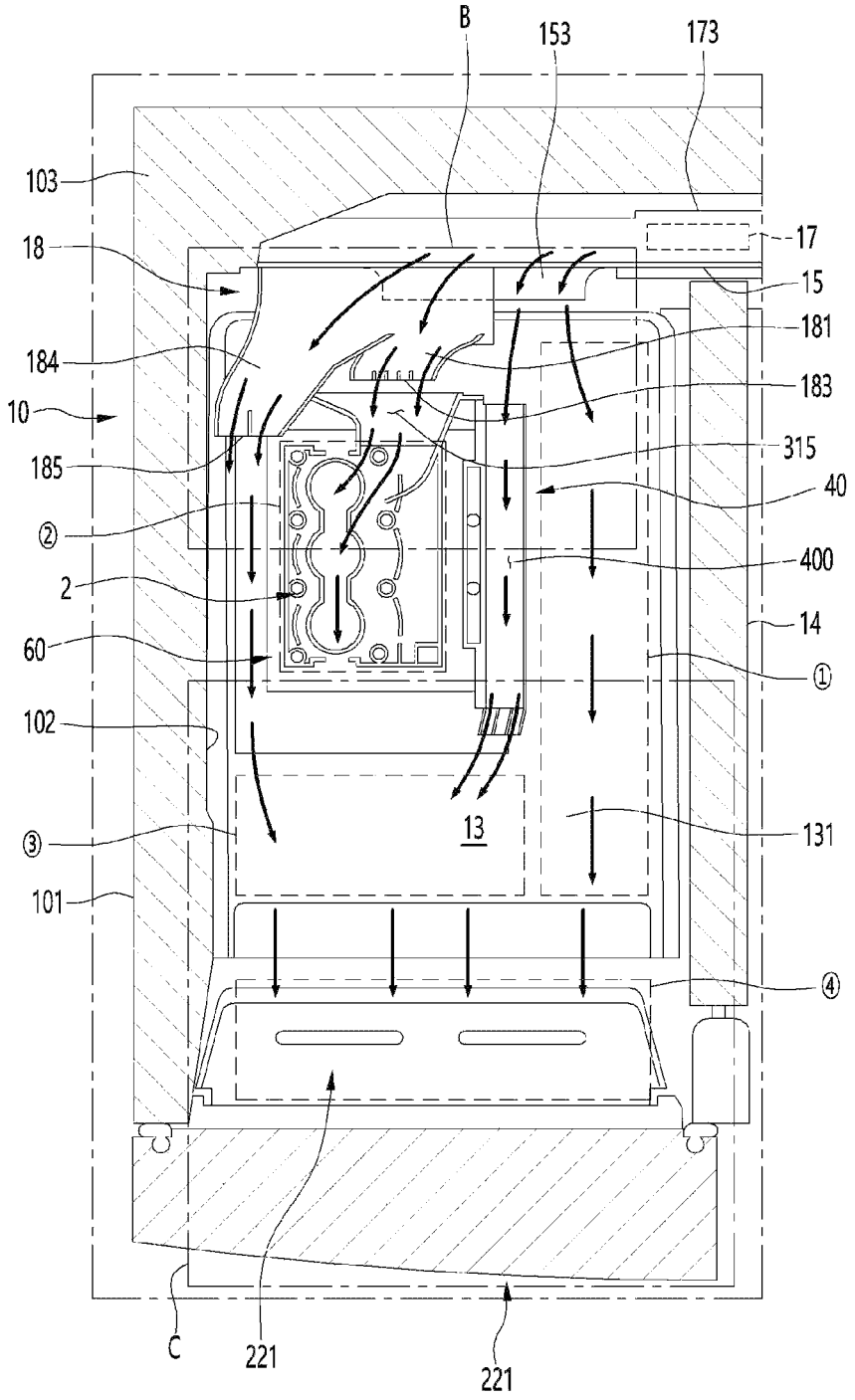
FIG. 17 is a transverse cross-sectional view illustrating states of cold air flow in the lower storage space.
Figure 18:
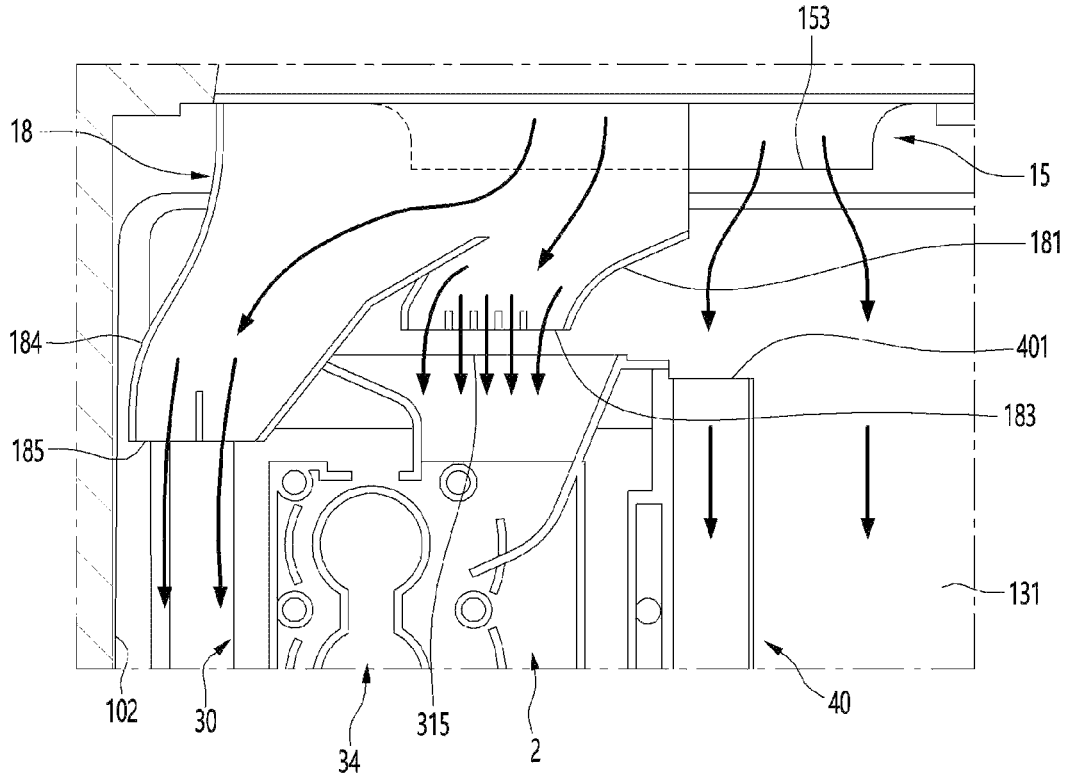
FIG. 18 is an enlarged view of portion B of FIG. 17.
Figure 19:
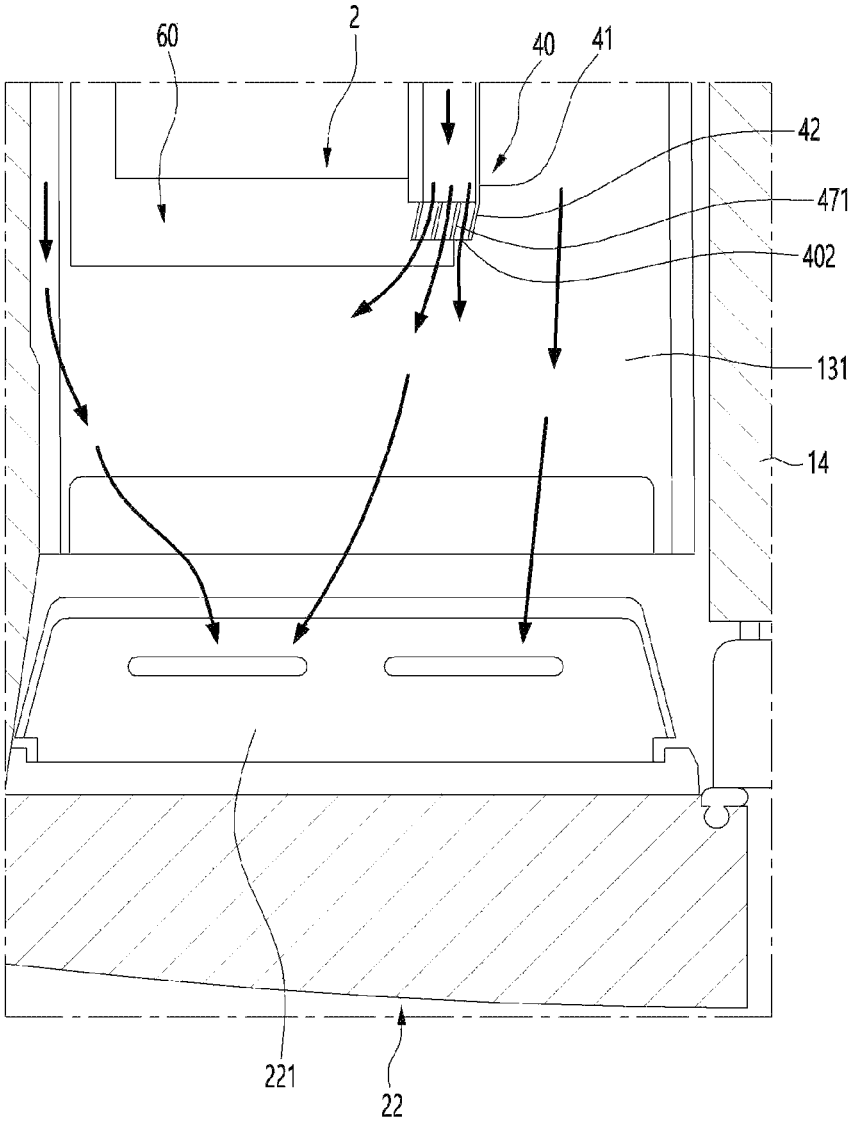
FIG. 19 is an enlarged view of portion C of FIG. 17.
Figure 20:
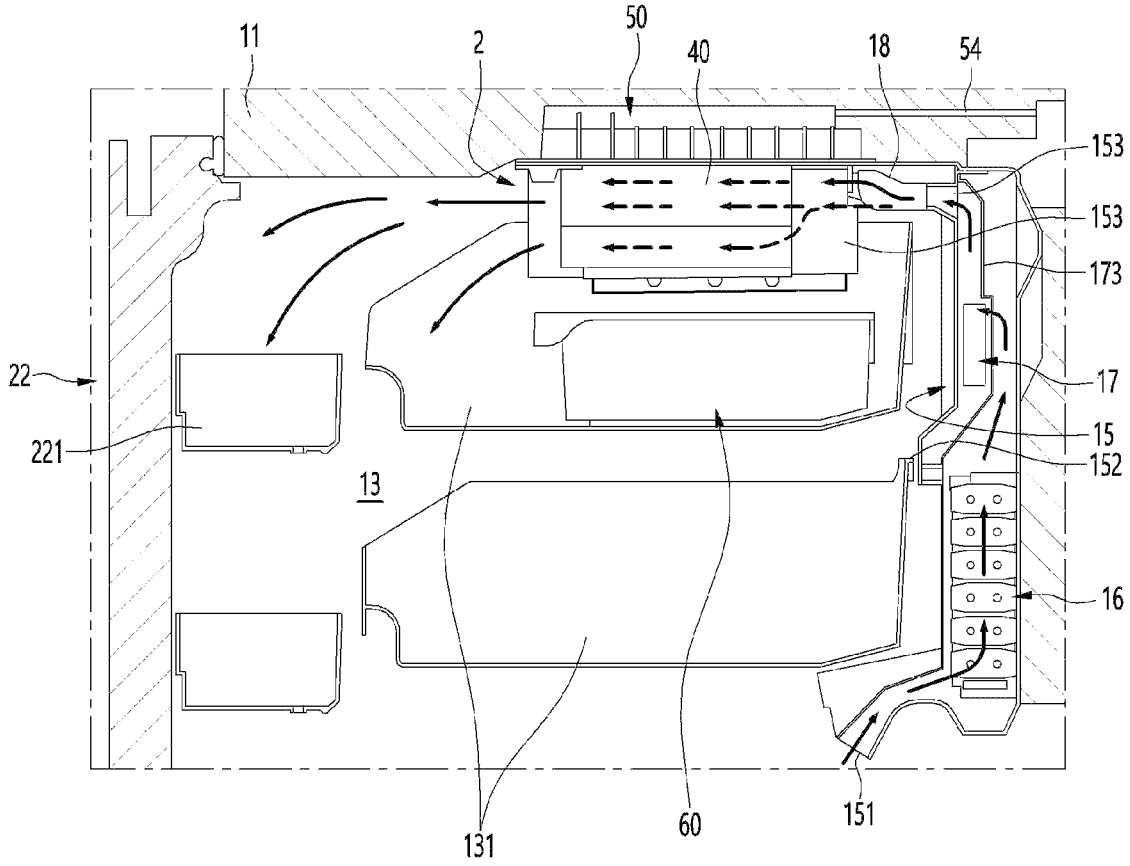
FIG. 20 is a longitudinal cross-sectional view illustrating states of cold air flow inside the freezer compartment.

FIG. 17 is a transverse cross-sectional view illustrating states of cold air flow in the lower storage space. Also, FIG. 18 is an enlarged view of portion B of FIG. 17. Also, FIG. 19 is an enlarged view of portion C of FIG. 17. Also, FIG. 20 is a longitudinal cross-sectional view illustrating states of cold air flow inside the freezer compartment.

As illustrated in the drawings, a refrigeration cycle may be driven to cool the freezer compartment 13, and cold air may be generated due to a heat exchange with surrounding air in the evaporator 16. When the air blower fan 17 is operated in this state, the cold air generated in the evaporator 16 flows toward the discharge port 153 through the fan case 173 and may be discharged to the inside of the freezer compartment 13 through the discharge port 153. Also, air inside the freezer compartment 13 may be suctioned through the suction port 151 and flow to the evaporator 16. By such circulation of cold air, the freezer compartment 13 may be cooled to a set temperature.

Meanwhile, more specifically, with regards to the flow of cold air discharged through the discharge port 153, first, the guide duct 18 is provided at the discharge port 153, and accordingly, some of the cold air discharged through the discharge port 153 may be introduced into the guide duct 18.

Also, some of the cold air introduced into the guide duct 18 may head toward the inside of the ice maker 2 through a first guide outlet 183 of the ice maker supply portion 181. The cold air discharged through the first guide outlet 183 may be introduced into the ice maker 2 through the ice maker inlet 315. Also, the cold air introduced into the ice maker 2 cools an area corresponding to an upper portion of the cell C (area (2) in FIG. 17) inside the ice maker 2. Also, cold air inside an ice maker flow path 310 may flow downward via the case upper surface 32 and cool the ice tray 35 as a whole.

In this way, the ice maker 2 may cool the inside of the cell C using cold air supplied through the first guide outlet 183 and make spherical ice. When spherical ice is made, the lower tray 33 may be rotated by the driving device 300, and the ejector 36 and the lower ejector 38 may be operated. Ice balls inside the cells C may be transferred downward by the ejector 36 and the lower ejector 38 and stored in the ice bin 60.

Also, some of the cold air introduced into the guide duct 18 may be guided to a side of the ice maker 2 through the side supply portion 184, and cold air may be discharged to a space between one sidewall surface (left side surface in FIG. 17) of the freezer compartment 13 and a side surface of the ice maker 2 through a second guide outlet 185.

Accordingly, some of the cold air discharged from the discharge port 153 may be guided forward along the left side surface of the ice maker 2 through the guide duct 18. That is, one sidewall surface of the freezer compartment 13 and one side surface (left side surface in FIG. 17) of the case peripheral surface 31 are adjacent to each other and form a flow path that is open in the front-rear direction. Accordingly, the cold air discharged through the second guide outlet 185 may flow along the side surface of the ice maker 2 and be supplied to the space in front of the ice maker 2 (area (3) in FIG. 17).

Also, the cold air supplied to the front of the ice maker 2 may flow further forward and cool an inner space of the door basket 221 (area (4) in FIG. 17).

Meanwhile, cold air discharged from the remaining portion of the discharge port 153 that is exposed to a side of the guide duct 18 heads forward. Also, some of the cold air discharged from the discharge port 153 is introduced into the inlet 401 of the side duct 40 and moves forward along the side duct 40.

That is, some of the cold air discharged from the discharge port 153 may, without being dispersed and spread at a front of the discharge port 153, move forward along the side duct 40, be guided to a front end of the ice maker 2, and then intensively cool the space in front of the ice maker 2 (area (3) in FIG. 17).

The inclined portion 42 inclined toward the ice maker 2 is formed at the front end of the side duct 40, and the duct grille 47 is formed inside the side duct 40, and thus cold air discharged from the outlet 402 of the side duct 40 has directivity and heads toward the space in front of the ice maker 2 (area (3) in FIG. 17).

That is, as illustrated in FIG. 19, cold air discharged from the outlet of the side duct 40 may head further toward the left than the side surface of the ice maker 2, and accordingly, cold air may be intensively supplied more effectively to the space in front of the ice maker 2.

Also, cold air discharged from the outlet 402 of the side duct 40 may flow to the inner space of the door basket 221 (area (4) in FIG. 17) via the space in front of the ice maker 2 and cool the inner space of the door basket 221.

Meanwhile, the discharge port 153 may protrude further toward the outside (right side in FIG. 17) than the side duct 40, and an outer side end of the discharge port 153 may be exposed when viewed from the front. Accordingly, some of the cold air discharged from the discharge port 153 may head forward from a place that is further toward the outside than the side duct 40 and may be supplied to an inner space of the freezer compartment storage member 131 (area (1) in FIG. 17) and cool the inside of the freezer compartment storage member 131.

Also, cold air discharged from the discharge port 153 may flow to the inner space of the door basket 221 (area (4) in FIG. 17) via the inner space of the freezer compartment storage member 131 and may cool the inner space of the door basket 221.

In this way, cold air discharged from the discharge port 153 may be supplied to each of a portion between a sidewall of the freezer compartment 13 and a side surface of the ice maker 2, the inside of the ice maker 2, the inside of the side duct 40, and the inside of the freezer compartment storage member 131 disposed outside the side duct 40.

Also, with the above structure, it becomes possible to supply cold air to the space in front of the ice maker 2 (area (3) in FIG. 17) and the inner space of the door basket 221 (area (4) in FIG. 17), where the supply of cold air is relatively poor due to the discharge port 153 being covered by the ice maker 2. In particular, by the guide duct 18 and the side duct 40, cold air may flow along both left and right sides of the ice maker 2 and be guided to the front of the ice maker 2 and may also be supplied to the door basket 221.

As a result, cold air can be supplied even to positions where cold air is difficult to reach due to the arrangement of the ice maker 2, and uniform cooling performance can be ensured in all the areas inside the freezer compartment 13 (areas (1), (2), (3), and (4) in FIG. 17).

Accordingly, areas of the freezer compartment storage member 131 where food can be placed (areas (1) and (3) in FIG. 17) and the inner space of the door basket 221 (area (4) in FIG. 17) all satisfy required cooling performance, and thus low-temperature food storage performance can be ensured regardless of the position.

INDUSTRIAL APPLICABILITY

A refrigerator according to an embodiment of the present disclosure can facilitate supply of cold air and improve cooling performance and thus has high industrial applicability.

The invention claimed is:

1. A refrigerator comprising:

a cabinet defining a storage space;

a door configured to open and close at least a portion of the storage space;

a discharge port configured to discharge cold air into the storage space; and an ice maker provided inside the storage space and configured to make ice, wherein the ice maker includes:

an ice tray having a cell configured to receive water therein to make the ice, a case configured to accommodate the ice tray, and a first duct configured to guide the cold air discharged from the discharge port, wherein the first duct is provided at a first surface of the case that is positioned away from a surface of the storage space, wherein the case includes a second surface that faces and is spaced apart from the surface of the storage space, wherein the refrigerator further comprises a second duct configured to guide the cold air discharged from the discharge port, the second duct being provided between the ice maker and the discharge port, and wherein the second duct includes:

a first supply portion extending toward the ice maker and configured to supply the cold air discharged from the discharge port to the ice maker, and a second supply portion extending to a separation space between the second surface of the case and the surface of the storage space and configured to allow a portion of the cold air discharged from the discharge port to flow along the ice maker.

2. The refrigerator of claim 1, wherein:

the case has a first case surface provided at one surface of the case and a second case surface that extends in a direction from the first case surface to define a space in which the ice tray is accommodated; and the first duct is disposed at the second case surface.

3. The refrigerator of claim 2, wherein the first case surface is a case upper surface provided at an upper surface of the case, and wherein the second case surface is a case peripheral surface extending downward from the first case surface to define the space in which the ice tray is accommodated.

4. The refrigerator of claim 2, wherein the first duct includes:

a first restrainer provided at one portion of the first duct and coupled to the first case surface; and a second restrainer provided at another portion of the first duct and coupled to an end of the second case surface.

5. The refrigerator of claim 1, wherein the first duct includes:

a first portion that extends from an inlet of the first duct and extends according to one of the first and the second surfaces of the case; and a second portion that extends from an end of the first portion to an outlet of the first duct and extends in a direction approaching the one of the first and the second surfaces of the case.

6. The refrigerator of claim 1, wherein:

the first duct includes a duct body (i) having an inlet and an outlet that are open at one surface and another surface thereof, respectively, and (ii) defining a cold air flow path; and a duct grille that divides an inside of the duct body and is provided in the duct body.

7. The refrigerator of claim 6, wherein an inclined surface is provided at a portion of the duct body, the inclined surface increasingly protruding outward in a direction.

8. The refrigerator of claim 6, wherein the duct grille is sloped to become closer to one of the first and second surfaces of the case in a direction toward the outlet.

9. The refrigerator of claim 1, wherein the first duct defines (i) an inlet facing the discharge port and (ii) an outlet facing the door, and the first duct is configured to guide the cold air.

10. The refrigerator of claim 1, wherein the first surface is a left side surface of the case, and the second surface is a right side surface of the case.

11. The refrigerator of claim 1, wherein the first duct is a side duct, and the second duct is a guide duct, wherein the first supply portion is an ice maker supply portion, wherein the second supply portion is a side supply portion, and wherein the side supply portion extends to the separation space between a side surface of the case and a side surface of the storage space, the side supply portion being configured to allow the portion of the cold air discharged from the discharge port to flow along a side of the ice maker and move toward a front of the ice maker.

12. The refrigerator of claim 1, wherein the discharge port laterally protrudes past the ice maker and the first duct.

13. The refrigerator of claim 12, wherein:

the second duct is configured to supply the cold air discharged from the discharge port to the ice maker and is provided between the discharge port and the ice maker; and one portion of the discharge port communicates with the second duct, and another portion of the discharge port is open toward an inlet of the first duct and configured to supply the cold air to the first duct.

14. The refrigerator of claim 1, wherein:

a door basket is provided at a surface of the door; and an outlet of the first duct is open toward the door basket.

15. A refrigerator comprising:

a cabinet defining a storage space;

a door configured to open and close at least a portion of the storage space;

an ice maker provided inside the storage space and configured to make ice;

a discharge port configured to discharge cold air into the storage space; and a guide duct provided between the ice maker and the discharge port, the guide duct being configured to guide the cold air discharged from the discharge port, wherein the ice maker comprises:

an ice tray having a cell configured to receive water therein to make the ice, and a case configured to accommodate the ice tray, wherein a side surface of the case faces and is spaced apart from a side surface of the storage space, and wherein the guide duct comprises:

an ice maker supply portion that extends toward the ice maker and is configured to supply the cold air discharged from the discharge port to the ice maker, and a side supply portion that extends to a separation space between the side surface of the case and the side surface of the storage space and is configured to allow a portion of the cold air discharged from the discharge port to flow along a side of the ice maker.

16. The refrigerator of claim 15, wherein the guide duct further comprises a duct insertion portion into which the discharge port is inserted.

17. A refrigerator comprising:

a cabinet defining a storage space;

a door configured to open and close at least a portion of the storage space;

an ice maker provided inside the storage space and configured to make ice; and a discharge port configured to discharge cold air into the storage space, wherein the ice maker includes:

an ice tray having a cell configured to receive water therein to make the ice, a case configured to accommodate the ice tray, and a side duct configured to guide the cold air discharged from the discharge port, and wherein the side duct is provided at a side surface of the case that is positioned away from a side surface of the storage space.

18. The refrigerator of claim 17, wherein the discharge port laterally protrudes past the ice maker.

19. The refrigerator of claim 18, wherein the side duct defines (i) an inlet facing the discharge port and (ii) an outlet facing the door, the side duct being configured to guide the cold air discharged from the discharge port to bypass the ice maker, and wherein the discharge port laterally protrudes past the side duct.

* * * * *